US006550620B2

(12) United States Patent
Fukudome et al.

(10) Patent No.: US 6,550,620 B2
(45) Date of Patent: Apr. 22, 2003

(54) PULP SCREENING DEVICE

(75) Inventors: Hiromi Fukudome, Hiroshima-ken (JP); Koukichi Maedera, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/764,210

(22) Filed: Jan. 19, 2001

(65) Prior Publication Data

US 2001/0011641 A1 Aug. 9, 2001

(30) Foreign Application Priority Data

Feb. 4, 2000 (JP) ..... 2000-028281

(51) Int. Cl.[7] ..... B07B 1/20
(52) U.S. Cl. ..... 209/306; 209/379; 209/397
(58) Field of Search ..... 209/268, 306, 209/369, 379, 918, 392, 397; 210/326

(56) References Cited

U.S. PATENT DOCUMENTS

| | | | | | |
|---|---|---|---|---|---|
| 2,975,899 | A | | 3/1961 | Cannon et al. | |
| 3,261,468 | A | | 7/1966 | Dick | |
| 3,497,060 | A | * | 2/1970 | Tra et al. | |
| 3,786,918 | A | * | 1/1974 | Holz | 209/273 |
| 4,676,903 | A | * | 6/1987 | Lampenius et al. | 210/413 |
| 4,717,471 | A | * | 1/1988 | Winkler | 209/273 |
| 5,000,842 | A | * | 3/1991 | Ljokkoi | 209/273 |
| 5,009,774 | A | * | 4/1991 | LeBlanc | 209/273 |
| 5,073,254 | A | * | 12/1991 | Beisenhertz et al. | 209/273 |
| 5,176,261 | A | | 1/1993 | Holz | |
| 5,259,512 | A | * | 11/1993 | Czerwoniak | 209/273 |
| 5,497,886 | A | | 3/1996 | Young et al. | |
| 5,524,770 | A | * | 6/1996 | LeBlanc et al. | 209/273 |
| 5,624,558 | A | * | 4/1997 | Aaltonen et al. | 210/415 |
| 5,884,774 | A | * | 3/1999 | Aikawa | 209/273 |
| 6,119,867 | A | * | 9/2000 | Ljokkor et al. | 209/273 |
| 6,311,850 | B1 | * | 11/2001 | Friedrich et al. | 210/415 |

FOREIGN PATENT DOCUMENTS

| | | | |
|---|---|---|---|
| DE | 19747653 A1 * | 1/1999 | B23P/13/00 |
| DE | 197 47 653 A 1 | 1/1999 | |
| JP | 45-11907 | 5/1970 | |
| JP | 61-168199 | 10/1986 | |

* cited by examiner

*Primary Examiner*—Donald P. Walsh
*Assistant Examiner*—Mark J. Beauchaine
(74) *Attorney, Agent, or Firm*—Armstrong, Westerman & Hattori, LLP

(57) ABSTRACT

The present invention is a pulp screening device which is capable of screening a large quantity of pulp with low power, by preventing clogging of a screen cylinder. The device is provided with one or a plurality of vanes which revolve within an agitation chamber formed between a pair of inner and outer screen cylinders, holding a predetermined small space from each of the inner and outer screen cylinders. The agitation chamber is practically partitioned in the circumferential direction by the vanes.

14 Claims, 26 Drawing Sheets

1a : OUTER SCREEN CYLINDER
1b : INNER SCREEN CYLINDER
4 : FLOW PASSAGE
7 : AGITATION CHAMBER
12 : COMMON VANE
15 : INNER DISCHARGE TUBE
16 : OUTER DISCHARGE TUBE
14a : OUTER EXIT CHAMBER
14b : INNER EXIT CHAMBER

1a: OUTER SCREEN CYLINDER
1b: INNER SCREEN CYLINDER
4: FLOW PASSAGE
6: ROTOR
7: AGITATION CHAMBER

12: COMMON VANE
15: INNER DISCHARGE TUBE
16: OUTER DISCHARGE TUBE
14a: OUTER EXIT CHAMBER
14b: INNER EXIT CHAMBER

6 : ROTOR
12 : COMMON VANE
30 : CONNECTING RING

12 : COMMON VANE
201 : FRONT WALL
202 : DEFLECTION WALL
203 : EDGE
204 : REAR CURVED FACE
205 : TIP END
206 : REAR END

1a : OUTER SCREEN CYLINDER
1b : INNER SCREEN CYLINDER
7 : AGITATION CHAMBER
12 : COMMON VANE
100 : HOLE
201 : FRONT WALL
202 : DEFLECTION WALL
203 : EDGE
204 : REAR CURVED FACE
205 : TIP END
206 : REAR END

1a : OUTER SCREEN CYLINDER
1b : INNER SCREEN CYLINDER
7 : AGITATION CHAMBER
14a : OUTER EXIT
14b : INNER EXIT CHAMBER
21 : DISTRIBUTION VANE

1a : OUTER SCREEN CYLINDER
1b : INNER SCREEN CYLINDER
7 : AGITATION CHAMBER
14a : OUTER EXIT CHAMBER
14b : INNER EXIT CHAMBER
21 : DISTRIBUTION VANE

6 : ROTOR

21 : DISTRIBUTION VANE

30 : CONNECTING RING

21 : DISTRIBUTION VANE
401 : FRONT EDGE
402 : INNER DISTRIBUTION WALL
403 : OUTER DISTRIBUTION WALL
404 : INNER EDGE
405 : OUTER EDGE
406 : INNER SUCTION WALL
407 : OUTER SUCTION WALL
408 : REAR EDGE

1a : OUTER SCREEN CYLINDER
1b : INNER SCREEN CYLINDER
7 : AGITATION CHAMBER
21 : DISTRIBUTION VANE
401 : FRONT EDGE
402 : INNER DISTRIBUTION WALL
403 : OUTER DISTRIBUTION WALL
404 : INNER EDGE
405 : OUTER EDGE
406 : INNER SUCTION WALL
407 : OUTER SUCTION WALL
408 : REAR EDGE

1a : OUTER SCREEN CYLINDER
50 : HOLE
51 : CONICAL HOLLOW
52 : FRONT EDGE
53 : REAR EDGE

1a : OUTER SCREEN CYLINDER
50 : HOLE
51 : CONICAL HOLLOW
52 : FRONT EDGE
53 : REAR EDGE
54 : INCLINED PORTION
S : TURBULENCE

PULP SCREENING DEVICE

TECHNICAL FIELD

The present invention relates to a pulp screening device for separating good-quality fibers and foreign objects in paper pulp.

BACKGROUND ART

On the upstream side of a paper machine, there is provided a pulp screening device (pulp screen). The pulp screening device is a device for screening and separating good-quality fibers and foreign objects in paper pulp (i.e., a pulp suspension with a pulp density of 0.2 to 5%) with a screen cylinder thereof. Typically, the pulp screening device is equipped with one or two screen cylinders. First, the construction of a pulp screening device with a single screen cylinder will be described with reference to FIGS. 28 and 29. FIG. 28 shows a part-sectional plan view of a conventional pulp screening device. FIG. 29 shows a part-sectional side view taken in the direction of arrow D of FIG. 28.

A pulp suspension is fed to the pulp screening device by a pump. As illustrated in FIGS. 28 and 29, the pulp suspension flows in a tangential direction through the entrance 2 of a cylindrical container 17, and advances in an annular flow passage 4, formed by an inner casing 3 and the inner wall of the container 17. When the pulp suspension is circulating through the annular flow passage 4, heavy foreign objects such as sand, etc., are discharged outside the device from a trap 5 provided in the tangential direction opposite to the entrance 2, and the remaining pulp flows inside the inner casing 3 through the flow passage 4. Note that a cover 19 is provided on the upper surface of the container 17 so that the device can be operated under pressure.

A cylindrical screen cylinder 1 is disposed inside the inner casing 3. The upper portion of the screen cylinder 1 is fixedly attached to the inner casing 3, and this screen cylinder 1 partitions the inner side of the inner casing 3 into an agitation chamber 7 and an exit chamber 14. The pulp flowing in the flow passage 4 first flows in the annular agitation chamber 7 formed inside the screen cylinder 1.

A large number of slits of width 0.15 to 0.5 mm or holes of diameter 0.2 to 4.8 mm are provided in the peripheral surface of the screen cylinder 1, and the pulp is filtered and sorted by these slits or holes when flowing downward along the agitation chamber 7. That is, the good-quality fibers that can pass through the slits or holes in the peripheral surface of the screen cylinder 1 are discharged from an exit 9 via the exit chamber 14, while the foreign objects of sizes that cannot pass through the slits or holes in the screen cylinder, as they are, flow downward along the agitation chamber 7 and are discharged from a reject exit 10.

In addition, a rotor 6 is disposed within the agitation chamber 7. The rotor 6 is hung from the upper portion of a main shaft 11 and is equipped with a plurality of vanes 20 at equal spaces in the circumferential direction. The vane 20 is positioned, holing a predetermined space (2.5 to 8 mm) from the inner peripheral surface of the screen cylinder 1. The main shaft 11 is supported by bearings so that it is free to rotate, and is driven to rotate by an electric motor 13 through a V-pulley (not shown) mounted on the lower end portion thereof. If the rotor 13 rotates and therefore the vanes 20 revolve within the annular agitation chamber 7, the pulp suspension within the agitation chamber 7 is agitated. The foreign objects in the pulp are separated, and tangled fibers are untangled. As a result, clogging of the slits or holes in the screen cylinder 1 is prevented.

FIG. 30 shows how clogging of the slits or holes in the screen cylinder 1 is prevented by the vanes 20. As illustrated in FIG. 30A, the vane 20 revolves along the surface of the screen cylinder 1 at high speeds (10 to 30 m/s), holding a constant space from the cylinder surface. When the valve 20 is revolving, negative pressure is developed between the vane 20 and the screen cylinder 1, as shown in FIG. 30B. The suction force, developed by this negative pressure, causes the solution to flow backward into the agitation chamber 7 and therefore the tangled fibers or foreign objects, blocking holes 100 in the surface of the screen cylinder 1, are removed. After passage of the vane 20, the pulp suspension will flow from the agitation chamber 7 into the exit chamber 14 again, and the holes 100 in the screen cylinder 1 will be clogged with tangled fibers and foreign objects. However, the tangled fibers, etc., newly blocking the holes 100, are removed by the negative pressure produced by passage of the next vane 20. In the conventional pulp screening device, clogging of the holes in the screen cylinder 1 is prevented by repeating the aforementioned operation.

FIG. 31 shows a sectional view of the configuration of the hole 100 in the screen cylinder 1. The hole 100 is circular in shape, and a chamfered face 101 in the form of a dish is formed coaxially at the inlet of the hole 100 (on the side of the agitation chamber 7). When the vane 20 passes over the chamfered surface 101 in the surface of the screen cylinder 1, a turbulence (separating vortex) develops at the inlet of the hole 100, as shown by an arrow S in FIG. 31, and clogging of the hole 100 is suppressed by the turbulence S.

Furthermore, there are screen plates 1 of cross sections such as those shown in FIGS. 32 and 33. In the case of FIG. 32, trapezoidal grooves 111 are formed in the axial direction of the screen plate 1 (perpendicular to the paper surface) and forms a plurality of holes 110 at the bottoms of the grooves 33. In the case of FIG. 33, an axial waveform is formed on the peripheral surface of the screen cylinder 1, and a plurality of holes 120 are bored axially in the inclined portion 121 of the waveform. In any of the cross sections shown in FIGS. 32 and 33, revolution flow caused by the vane 20 develops a turbulence Sat the inlet of the hole, thereby preventing clogging of the hole.

Now, the construction of a pulp screening device with a double screen cylinder (inner and outer screen cylinders) will be described with reference to FIGS. 34 and 35. FIG. 34 shows a sectional view of the conventional pulp screening device with two inner and outer screen cylinders, and FIG. 35 shows a sectional view taken substantially along line E—E in FIG. 34. Note that the same reference numerals will be applied to the same parts as the aforementioned conventional pulp screening device having a single screen cylinder.

As illustrated in FIGS. 34 and 35, a pulp suspension flows in a tangential direction through the entrance 2 of a cylindrical container 17 and circulates through an annular flow passage 4. When the pulp suspension is circulating through the annular flow passage 4, heavy foreign objects such as sand, etc., are discharged outside the device from a trap 5 provided in the tangential direction of the flow passage 4, and the remaining pulp suspension flows from the flow passage 4 to inside an inner casing 3.

Cylindrical screen cylinders 1*a* and 1*b* are disposed inside the inner casing 3. These screen cylinders 1*a* and 1*b* partition the inside of the inner casing 3 into an agitation chamber 7 and exit chambers 14*a*, 14*b*. The pulp suspension flowing in the flow passage 4 first flows in the annular agitation chamber 7, formed between the screen cylinders 1*a* and 1*b*. When the pulp suspension is flowing downward along the agitation chamber 7, part of the pulp passes through the inner screen cylinder 1*b* and is filtered and sorted in the inner exit chamber 14*b*. The remaining pulp passes through the outer screen cylinder 1*a*, and is filtered and sorted in the outer exit chamber 14. On the other hand, the foreign objects of sizes that cannot pass through the screen cylinders 1*a*, 1*b*, as they are, flow downward along the agitation chamber 7 and are discharged from a reject exit 10.

In addition, within the agitation chamber 7, a plurality of outer vanes 20*a* are disposed in opposition to the outer screen cylinder 1*a* and a plurality of inner vanes 20*b* are disposed in opposition to the inner screen cylinder 1*b*. The vanes 20*a*, 20*b* are fixedly attached to a rotor 6 hung from the upper portion of a main shaft 11. The outer vanes 20*a* are disposed at equal spaces in the circumferential direction, holding a constant space (2.5 to 8 mm) from the outer screen cylinder 1*a*. Similarly, the inner vanes 20*b* are disposed at equal spaces in the circumferential direction, holing the constant space (2.5 to 8 mm) from the inner screen cylinder 1*b*. The main shaft 11 is freely rotatably supported by bearings and is driven to rotate by an electric motor (not shown) through a V-pulley 18 mounted on the lower end portion thereof. If the rotor 13 rotates and therefore the vanes 20*a*, 20*b* revolve within the annular agitation chamber 7, the pulp suspension within the agitation chamber 7 is agitated. The foreign objects in the pulp are separated, and tangled fibers are untangled. As a result, clogging of the slits or holes in the screen cylinders 1*a*, 1*b* is prevented.

The aforementioned pulp screening devices, however, have the following problems:

First, the conventional pulp screening device shown in FIGS. 28 and 29 has a limit to its processing ability since it has only a single screen cylinder 1. In addition, because of the configuration of the conventional vane 20, the revolution flow caused by the vane 20 becomes faster as it is near the surface of the vane 20 and slower as it is away from the vane surface. Therefore, the efficiency of cleaning the surface of the screen cylinder 1 is low, and there is a problem that the passage amount of the pulp will be reduced. Furthermore, the surface of the vane 20 remote from the surface of the screen cylinder 1 wastefully consumes the power required for friction, because it makes no contribution to the cleaning of the surface of the screen cylinder 1.

In the conventional pulp screening device shown in FIGS. 34 and 35, the speed of the revolution flow, developed by revolution of the vanes 20*a* and 20*b*, is slower at the inner screen cylinder 1*b* than at the outer screen cylinder 1*a* because of the difference in diameter between the inner and outer screen cylinders 1*a* and 1*b*. In addition, the pressure acting on the inner screen cylinder 1*b* is lower than that acting on the outer screen cylinder 1*a* because of a difference in centrifugal force. Therefore, the outer screen cylinder 1*a* tends to pass the pulp to more than the effective area of the screen cylinder 1*a*, whereas the inner screen cylinder 1*b* tends to pass the pulp to less than the effective area of the screen cylinder 1*b*.

Because of this, when the quantity of pulp to be processed is excessively reduced, the outer screen cylinder 1*a* will pass the pulp therethrough, but there is a problem that the inner screen cylinder 1*b* will be liable to be clogged due to pulp flowing backward. Conversely, when the quantity of pulp to be processed is increased, the inner screen cylinder 1*b* will properly pass pulp therethrough, but there is a problem that the outer screen cylinder 1*a* will increase in passage resistance and will be likely to be clogged.

In addition, because revolution flow passes through between the inner and outer vanes 20*b*, 20*a*, the speed of the revolution flow within the agitation chamber 7 becomes faster only in the vicinities of the inner and outer vanes 20*b*, 20*a* and slower at positions away from the inner and outer vanes 20*b*, 20*a*. Because of this, the efficiency of cleaning the surfaces of the screen cylinders 1*a*, 1*b* is low and there is a problem that the quantity of pulp to be passed will be reduced. Furthermore, because of underagitation of pulp, a good quality of pulp will be discharged from the reject exit 10 without being processed by the screen cylinders 1*a*, 1*b*, and there is also a problem that the screening efficiency will be reduced.

In addition, as described above, the conventional pulp screening device has the problem that the quantity of pulp to be passed will be limited by clogging of the holes in the screen cylinder 1. The clogging of the holes in the screen cylinder 1 results from the configuration of the holes formed in the screen cylinder 1.

More specifically, the turbulence S (see FIGS. 31 to 33), developed at the inlet of the hole by the revolution flow resulting from revolution of the vane 20, has the effect of preventing the hole from being clogged. However, the strength of the turbulence S is affected by the configuration of the front edge of the hole (located on the upstream side of the revolution flow) In addition, the difficulty for tangled fibers to be caught, and the ease of removing foreign objects, are affected by the configuration of the rear edge of the hole (located on the downstream side of the revolution flow).

In the case of configuration such as that shown in FIG. 31, the turbulence S develops at the inclined surface, on the upstream side, of the hole 100 formed by the dish-shaped chambered surface 101, but the developed vertex S is weak because the inclined surface is gentle. Therefore, the turbulence S is less liable to reach the front edge 102 or rear edge 103 of the hole 100. Because of this, the effect of preventing clogging by the turbulence S is low. In addition, because the dish-shaped chambered surface 101 is formed coaxially with the hole 100, room for forming the dish-shaped chambered surface is required and the number of holes per unit area is thus limited. Because of this, there is a limit to increasing the quantity of pulp to be passed, by increasing the number of holes 100.

In addition, in the case of configuration such as the one shown in FIG. 32, the turbulence S which develops is strong, because the vertical portion of the trapezoidal groove 111 is located on the upstream side of flow. However, since the front edge 112 of the hole 110 is positioned at the groove bottom portion near the vertical portion of the trapezoidal groove 111, the vortex S developed is less likely to reach the front edge 112 and therefore the effect of preventing clogging of the hole 110 is low. Similarly, as the rear edge 113 is positioned at the groove bottom portion and is away from the inclined portion 114, separation of tangled fibers, etc, caught in the hole 100, is not easy. Besides, because the hole 110 can be disposed only in the bottom portion of the trapezoidal groove 111, the number of holes per unit area is also limited.

Furthermore, in the case of configuration such as that shown in FIG. 33, the turbulence S develops at the vertex of the waveform formed on the surface of the screen cylinder 1. However, the front edge 122 of the hole 120 is far from the vertex of the waveform and the front and rear edges 122, 123 are at the inclined portion 121 of the waveform. Therefore, the turbulence S is less likely to reach the edges 122, 123, and the effect of preventing clogging of holes by the turbulence S is thus low. In addition, since the rear edge 123 has an acute angle, separation of a lump of pulp, etc., caught on the edge, is not easy. Moreover, the number of holes per unit area is limited, because the hole 120 can be disposed only in the inclined portion 121 of the waveform.

As described above, in any of the hole configurations shown in FIGS. 31 to 33, the effect of preventing clogging by the turbulence S is not satisfactory. Therefore, it is necessary to make the turbulence S stronger by revolving the vanes 20 at high speeds in order to prevent clogging of holes. The power required for revolving the vanes 20, however, becomes greater in proportion to the square to cube of the revolution speed, so the quantity of passage per consumption power is inversely reduced.

DISCLOSURE OF THE INVENTION

The present invention has been made in view of the problems found in the prior art. Accordingly, it is the primary object of the present invention to provide a pulp screening device that is capable of screening a large quantity of pulp with low power, by preventing clogging of a screen cylinder.

To achieve this end and in accordance with one important aspect of the present invention, there is provided a pulp screening device, comprising:

a pair of inner and outer screen cylinders; and one or a plurality of vanes which revolve within an agitation chamber formed between the inner and outer screen cylinders, holding a predetermined small space from each of the inner and outer screen cylinders.

The agitation chamber can be practically partitioned in the circumferential direction, by providing the vanes which revolve within the agitation chamber formed between the inner and outer screen cylinders, holding a predetermined small space from each of the inner and outer screen cylinders. With this arrangement, the internal pressure within the agitation chamber becomes higher, as the revolution speed of pulp is increased. Therefore, the separation and agitation of foreign objects and lumps of pulp are accelerated, and clogging of the screen cylinders is prevented and the quantity of pulp to be passed is increased. In addition, the distance between the inner and outer screen cylinders can be shortened by sharing a single vane with the inner and outer screen cylinders. Because of this, the speed difference of the pulp between the inner and outer screen cylinders caused by the difference in diameter therebetween, and the pressure difference caused by centrifugal force, become smaller compared with prior art. Particularly, a reduction in the quantity of pulp to be passed due to clogging of the inner screen cylinder is prevented. Therefore, there is no possibility that the screen cylinders will be clogged even when the revolution speed of the vanes is relatively slow, and there is obtained an effect that a large quantity of pulp can be screened with low power.

In a first preferred form of the present invention, the revolution-direction front portion of the vane has a wall face extending radially toward the peripheral surfaces of the inner and outer screen cylinders. With this arrangement, the direction of the revolution flow of the pulp is changed from the circumferential direction to the radial direction by the wall face. The radial flow of the pulp renders it possible to partition the agitation chamber efficiently.

In a second preferred form of the present invention, the wall face is formed at a right or acute angle to the direction of revolution. With this arrangement, the revolution flow of the pulp can perpendicularly approach the peripheral surfaces of the inner and outer screen cylinders, and it becomes possible to partition the agitation chamber more efficiently.

In a third preferred form of the present invention, the cross section of the vane is formed so that the spacing between the cross section and each of the inner and outer screen cylinders widens gradually from the wall face in the direction of revolution. With this configuration, the pressure within the agitation chamber becomes negative on the rear portion side of the vane. Therefore, the pulp suspension flows backward from outside the inner and outer screen cylinders into the agitation chamber. As a result, lumps of pulp, etc., caught in the screen cylinders, are removed. In addition, the pulp density within the agitation chamber is diluted, and there is obtained an effect that repassage of the high-density pulp, which is not passed through the screen cylinders, becomes easy.

In a fourth preferred form of the present invention, the cross section of the vane is formed into the shape of a wedge extending at an acute angle from a revolution-direction tip end to both proximity portions closest to the inner and outer screen cylinders. With this shape, the position of the tip end of the vane can be adjusted by adjusting the incidence angle of the vane, and it becomes possible to supply pulp to the inner and outer screen cylinder equally.

In a fifth preferred form of the present invention, a distance from the tip end to both proximity portions is set to two to five times a distance between both proximity portions With this, there is no reduction in the screening efficiency of the screen cylinder and no rise in the operating power per unit processing ability of the screen cylinder. Therefore, clogging of the inner and outer screen cylinders is prevented, whereby it becomes possible to assure a large quantity of pulp to be passed with low power.

In a sixth preferred form of the present invention, the aforementioned tip end is disposed at a center between the inner and outer screen cylinders, or at a position offset from the center toward the outer screen cylinder. With this arrangement, the load for processing pulp can be balanced between the inner and outer screen cylinders.

In a seventh preferred form of the present invention, the cross section of the vane is formed so that the spacing between the cross section and each of the inner and outer screen cylinders widens gradually from both proximity portions in the direction of revolution. With this configuration, the pressure within the agitation chamber becomes negative on the rear portion side of the vane. Therefore, the pulp suspension flows backward from outside the inner and outer screen cylinders into the agitation chamber. As a result, lumps of pulp, etc., caught in the screen cylinders, are removed. In addition, the pulp density within the agitation chamber is diluted, and there is obtained an effect that repassage of the high-density pulp, which is not passed through the screen cylinders, becomes easy.

In an eighth preferred form of the present invention, adjacent vanes of the aforementioned plurality of vanes are connected by a partition wall. This further divides the agitation chamber into two parts. Therefore, flow from inside the agitation chamber to outside the agitation chamber, which is caused by centrifugal force, can be blocked, and it becomes possible to increase the quantity of pulp to be passed at the inner screen cylinder.

In a ninth preferred form of the present invention, the cross section of an inner discharge tube at a point where the inner discharge tube joins an outer discharge tube is set greater than the cross section of the outer discharge tube, pulp being passed through the inner screen cylinder and flowing in the inner discharge tube and also being passed through the outer screen cylinder and flowing in the outer discharge tube. With this setting, an effect is obtainable that the flow of the pulp from the inner discharge tube becomes satisfactory and that the quantity of pulp to be processed is thus increased.

To achieve the aforementioned object and in accordance with another important aspect of the present invention, there is provided a pulp screening device, comprising:

a screen cylinder; and one or a plurality of vanes which revolve within an agitation chamber formed outside or inside the screen cylinder, holding a predetermined small space from the screen cylinder;

wherein a revolution-direction front portion of the vane has a wall face extending radially toward the peripheral surface of the screen cylinder, and the vane is formed so that the spacing between the vane and the screen cylinder widens gradually from the wall face toward a revolution-direction rear end.

With such a construction, clogging of the screen cylinder can be prevented by making the difference in pressure within the agitation chamber greater before and after the wall face, and there is obtained an effect that a great quantity of pulp can be screened with low power.

To achieve the aforementioned object and in accordance with still another important aspect of the present invention, there is provided a pulp screening device, comprising:

a screen cylinder having a plurality of filter holes; and one or a plurality of vanes which revolve within an agitation chamber formed outside or inside the screen cylinder, holding a predetermined small space from the screen cylinder;

wherein a plurality of conical hollows are provided in the peripheral surface of the screen cylinder which faces the agitation chamber, and the filter hole is formed to be offset from the center of the conical hollow in the direction opposite to the direction in which the vane revolves.

With construction like this, a strong, turbulence is developed at the inlet of the filter hole by the revolution flow of the pulp, and the pulp is satisfactorily agitated. In addition, a lump of pulp and foreign objects are prevented from being caught in the filter holes, and clogging of the filter holes is prevented. Therefore, there is obtainable an effect that a large quantity of pulp can be screened with low power.

BEST MODE FOR CARRYING OUT THE INVENTION

Embodiments of the present invention will hereinafter be described with reference to the drawings.

Figure 1:
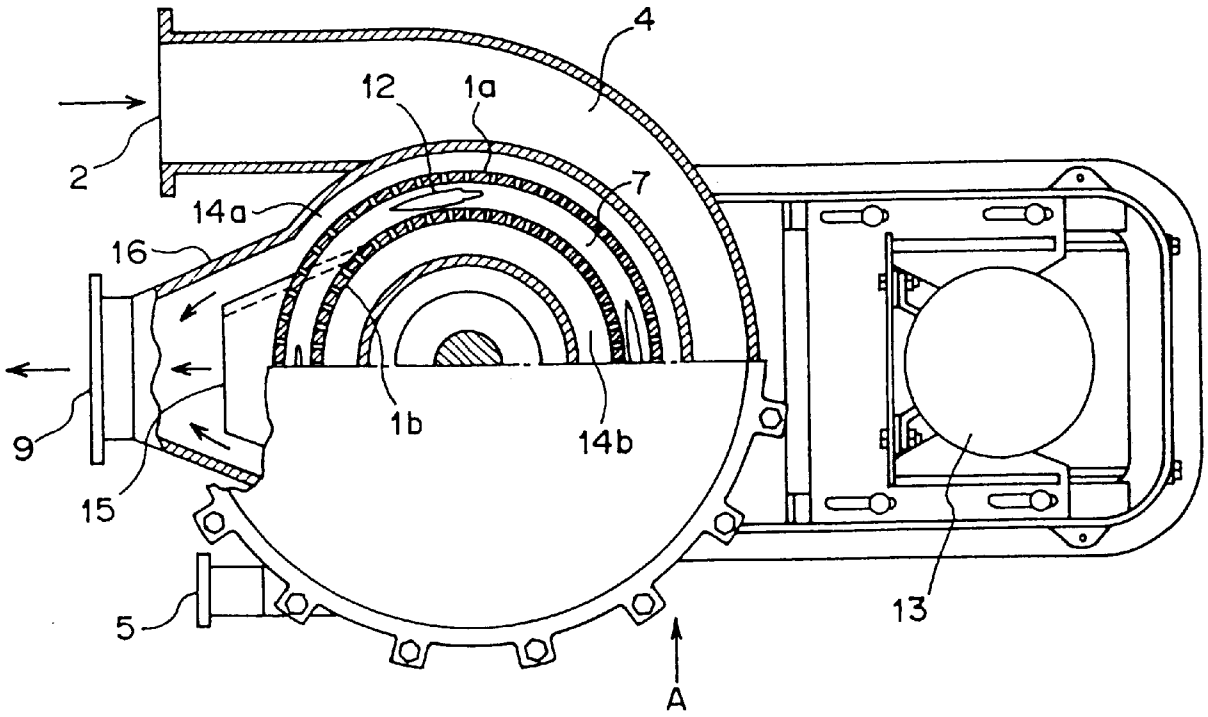
FIG. 1 is a part-sectional plan view showing a pulp screening device constructed according to a first embodiment of the present invention.
Figure 2:
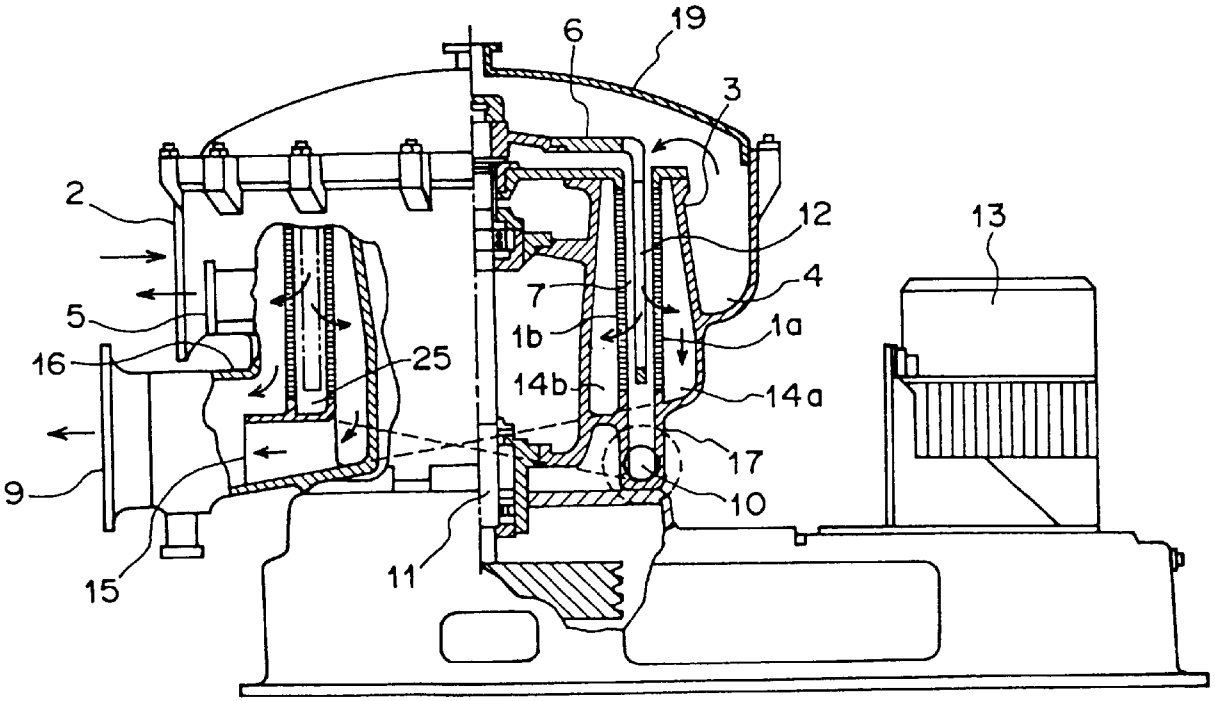
FIG. 2 is a part-sectional side view taken in the direction of arrow A of FIG. 1.
Figure 3:
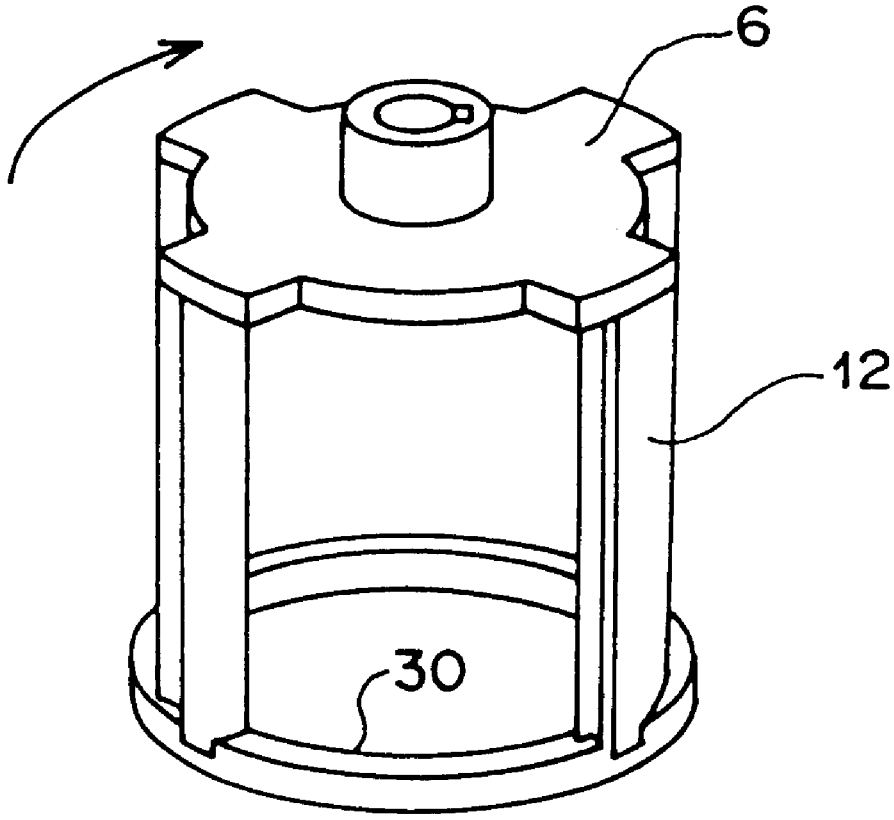
FIG. 3 is a perspective view showing the construction of the rotor of the pulp screening device of the first embodiment of the present invention.
Figure 4:
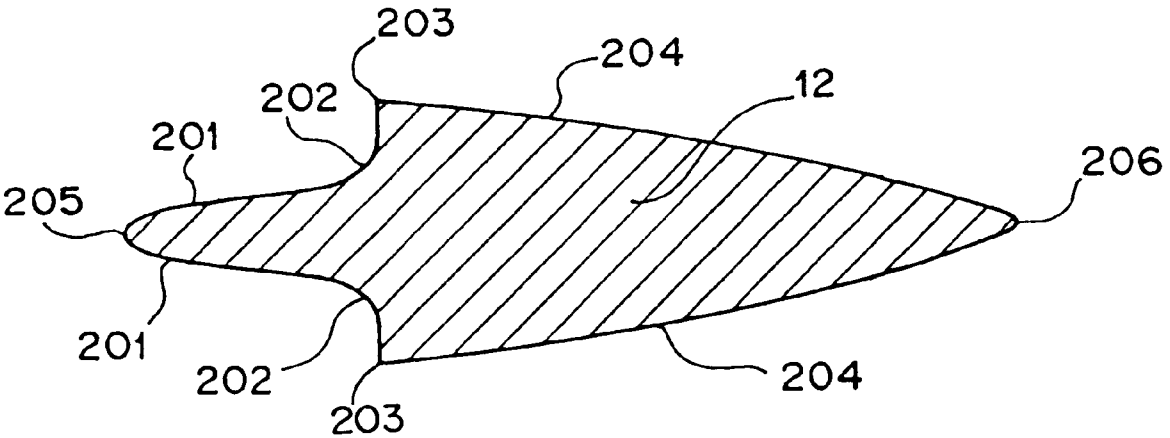
FIG. 4 is a sectional view showing the configuration of the vane of the pulp screening device of the first embodiment of the present invention.

FIGS. 1 through 5 show a pulp screening device constructed according to a first embodiment of the present invention. The pulp screening device will hereinafter be described with reference to FIGS. 1 to 5. FIG. 1 shows a part-sectional plan view of the construction of the pulp screening device. FIG. 2 shows a part-sectional side view taken in the direction of arrow A of FIG. 1. FIG. 3 shows a perspective view of the construction of the rotor of the pulp screening device. FIG. 4 shows a sectional view of the configuration of the common vane of the pulp screening device of the first embodiment. FIG. 5 shows a diagram for explaining the operational effect of the pulp screening device. Note that the same reference numerals will be applied to the same parts as the aforementioned conventional pulp screening device.

The pulp screening device has two screen cylinders 1*a*, 1*b* differing in diameter, as illustrated in FIGS. 1 and 2. An agitation chamber 7 is formed between the screen cylinders 1*a* and 1*b*. An outer exit chamber 14*a* is formed outside the outer screen cylinder 1*a*, and an inner exit chamber 14*b* is formed inside the inner screen cylinder 1*b*.

A pulp suspension, fed from a pump (not shown), first flows in a tangential direction through the entrance 2 of a cylindrical container 17 and circulates through an annular flow passage 4, formed by an inner casing 3 and the inner wall of the container 17. When the pulp suspension is circulating through the flow passage 4, heavy foreign objects such as sand, etc., are discharged outside the device from a trap 5 provided in the tangential direction opposite from the entrance 2. The remaining pulp flows from the flow passage 4 into the agitation chamber 7.

The screen cylinders 1*a*, 1*b* are provided in the peripheral surfaces thereof with a large number of slits of width 0.15 to 0.5 mm or holes of diameter 0.2 to 4.8 mm. Because of this, when the pulp suspension is flowing downward along the agitation chamber 7, part of the pulp passes through the inner screen cylinder 1*b* and is filtered and sorted in the inner exit chamber 14*b*, while the remaining pulp passes through the outer screen cylinder 1*a* and is filtered and sorted in the outer exit chamber 14*a*. On the other hand, the foreign objects of sizes that cannot pass through the screen cylinders 1*a*, 1*b*, as they are, flow downward along the agitation chamber 7 and are discharged from a reject exit 10 via a reject receiver 25.

In the pulp screening device, the inner exit chamber 14*b* and the outer exit chamber 14*a* are completely partitioned, and the pulp suspension, sorted in the outer exited chamber 14*a* from the agitation chamber 7, passes through an outer discharge tube 16 and is discharged from the exit 9. On the other hand, the pulp suspension sorted in the inner exit chamber 14*b* passes through an inner discharge tube 15 provided in the outer discharge tube 16, and is discharged from the exit 9, joining the pulp suspension flowing from the outer exit chamber 14*a* into the discharge 16. Note that the dimension of the cross section of the exit of the inner discharge tube 15 is set equal to or greater than the dimension of the cross section of the outer discharge tube 16 at a point where the outer discharge tube 16 joins the inner discharge tube 15. Also, the bottom surface of the inner exit chamber 14*b*, the bottom surface of the outer exit chamber 14*a*, and the bottom surface of the reject receiver 25 are inclined downward toward the exits 9 and 10 in order to prevent deposition of the pulp.

A cylindrical rotor 6 is hung from the upper portion of a main shaft 11 and disposed within the agitation chamber 7. The rotor 6 has a plurality of vanes 12 (hereinafter referred to as common vanes, because each vane in the first embodiment acts in common on the inner and outer screen cylinders) at its peripheral surface, as illustrated in FIG. 3. The common vanes 12 are interconnected at their lower ends by a connecting ring 30 and are disposed at equal spaces in the circumferential direction of the rotor 6. As illustrated in FIGS. 1 and 2, each common vane 12 is located within the agitation chamber 7, holding a predetermined space (preferably 2 to 6 mm) from the inner peripheral surface of the outer screen cylinder 1*a* and the predetermined space from the outer peripheral surface of the inner screen cylinder 1*b*. With this arrangement, the agitation chamber 7 in the pulp screening device of the first embodiment is practically partitioned in the circumferential direction by the common vanes 12.

Now, the configuration of the common vane 12 will be described. The common vane 12 in the pulp screening device of the first embodiment has a front wall 201 and a deflection wall 202, as illustrated in FIG. 4. The front wall 201 extends from a tip end 205 in the direction opposite to the direction of revolution, and the deflection wall 202 is continuous to the front wall 201 and extends in the radial direction of the rotor 6 (perpendicular to the direction of revolution). The deflection wall 202 is jointed to a pair of rear curved faces 204 extending from a rear end 206 in the direction of revolution, and the joined portion forms an acute-angle edge 203.

With the aforementioned vane configuration, the spacing, within the agitation chamber 7, between the common vane 12 and the screen cylinder 1*a* or 1*b* becomes gradually narrower from the tip end 205 toward the rear direction and then becomes even narrower suddenly at the deflection wall 202 and narrowest at the edge 203. In the pulp screening device of the first embodiment, the spacing between the edge 203 and the screen cylinder 1*a* or 1*b* is set to the aforementioned predetermined space (preferably 2 to 6 mm). Furthermore, the spacing widens gradually from the edge 203 to a rear end 206 (refer to FIG. 5A). Note that it is preferable that the deflection wall 202 be concave and also preferable that the angle of deflection at the deflection wall 202 (which is an angle, indicated by θ in FIG. 5A, which is fanned by both the direction of revolution and the direction in which the deflection wall 202 extends) be 90 degrees or less.

Now, a description will be made of the operation of the pulp screening device of the first embodiment constructed as described above.

The pulp suspension, fed from an upstream pump (not shown), first flows in a tangential direction through the entrance 2 of the container 17 and circulates through the flow passage 4. When the pulp suspension is circulating the flow passage 4, the heavy foreign objects in the pulp suspension, such as sand, etc., are discharged outside the device from the trap 5 provided in the tangential direction opposite to the entrance 2, and the remaining pulp flows into the agitation chamber 7, formed between the screen cylinders 1*a* and 1*b* inside the inner casing 3.

Figure 5A:
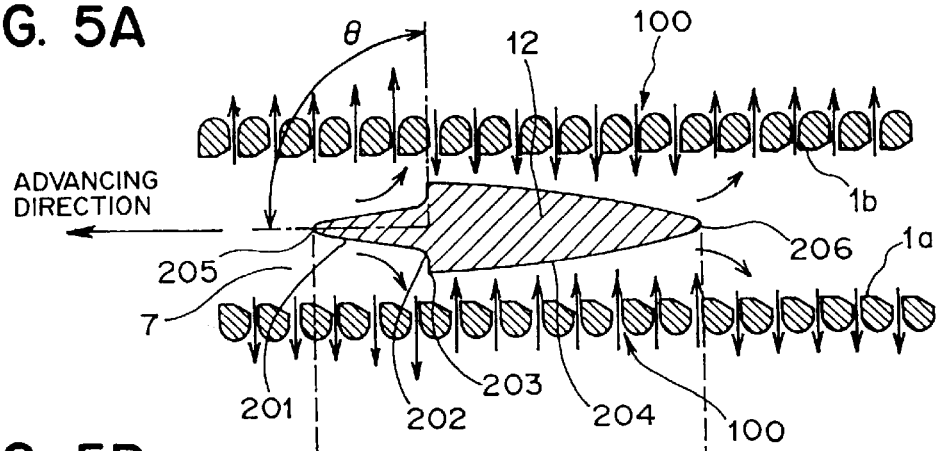
FIG. 5A is a diagram for explaining the operational effect of the pulp screening device of the first embodiment, the positional relationship between the inner and outer screen cylinders and the vane being shown.

If the common vane 12 revolves within and along the annular agitation chamber 7, as shown in FIG. 5A, the pulp within the agitation chamber 7 flows in the direction opposite to the direction of revolution of the common vane 12, relative to the common vane 12. However, because the common vane 12 is provided with the deflection wall 202 extending in the radial direction, the circumferential flow of the pulp strikes on the deflection wall 202 and is therefore changed to the radial flow. As a result, the flow of the pulp into the space between the screen cylinder 1*a* or 1*b* and the common vane 12 is suppressed. That is, the agitation chamber 7 is practically partitioned at the space between the screen cylinder 1*a* or 1*b* and the common vane 12, by the radial flow near the deflection wall 202.

Figure 5B:
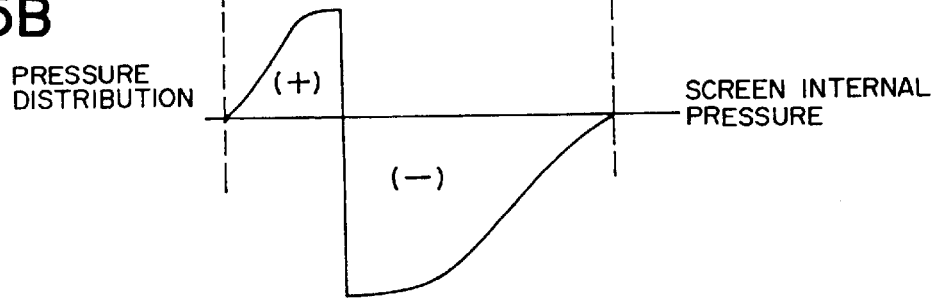
FIG. 5B is a diagram showing a pressure distribution that acts on the screen cylinders in the positional relationship shown in FIG. 5A.
Figure 31:
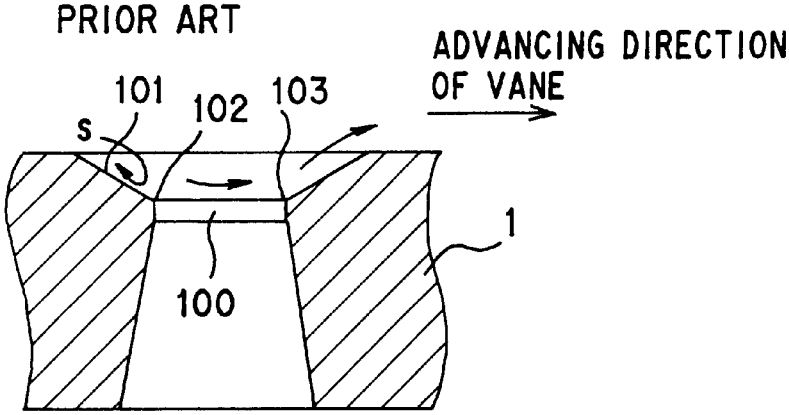
FIG.31 PRIOR ART
FIG. 31 is a sectional view showing the configuration of the hole in the screen cylinder of the conventional pulp screening device.
Figure 32:
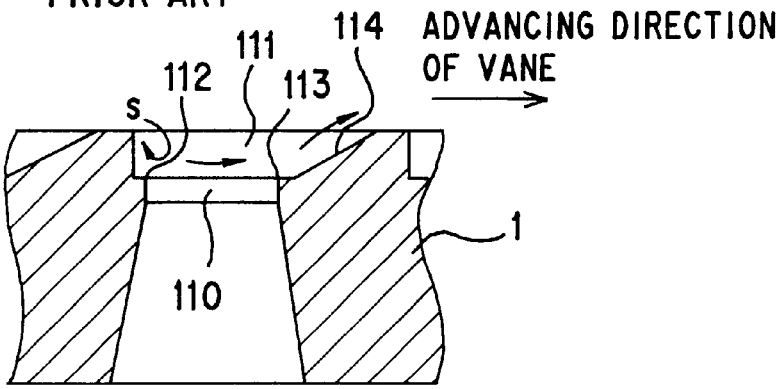
FIG.32 PRIOR ART
FIG. 32 is a sectional view showing a first variation of the hole in the screen cylinder of the conventional pulp screening device.
Figure 33:
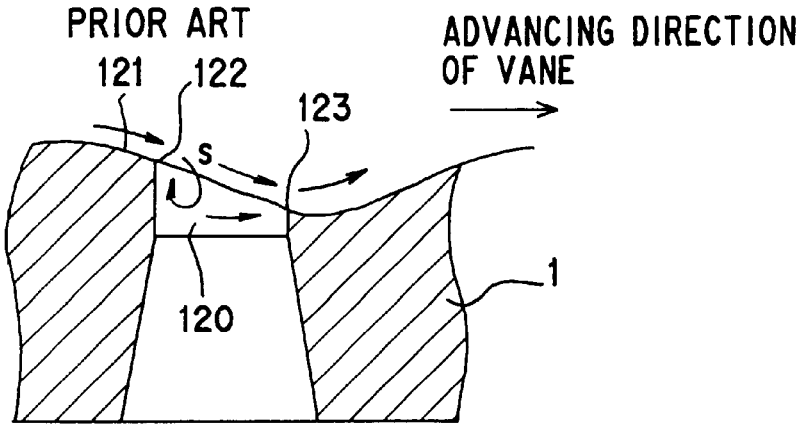
FIG.33 PRIOR ART
FIG. 33 is a sectional view showing a second variation of the hole in the screen cylinder of the conventional pulp screening device.

Thus, the agitation chamber 7 is practically partitioned into a plurality of parts in the circumferential direction by the radial flow of the pulp near the deflection walls 202. Therefore, the pulp, within the agitation chamber 7 partitioned into a plurality of parts, is pushed by the common vanes 12 and revolved in the circumferential direction at approximately the same speed as that of the common vane 12. Since the radial flow of the pulp toward the surface of the screen cylinder 1*a* or 1*b* is developed by the deflection wall 202, the internal pressure within the agitation chamber 7 rises greatly from the tip end 205 to the edge 203, as illustrated in FIG. 5B. The rise in the revolution speed of the pulp and the rise in the internal pressure accelerate the separation and agitation of foreign objects and lumps of pulp at the chamfered portions (see FIGS. 31 to 33) of the holes 100 in the surfaces of the screen cylinders 1*a*, 1*b*.

Figure 34:
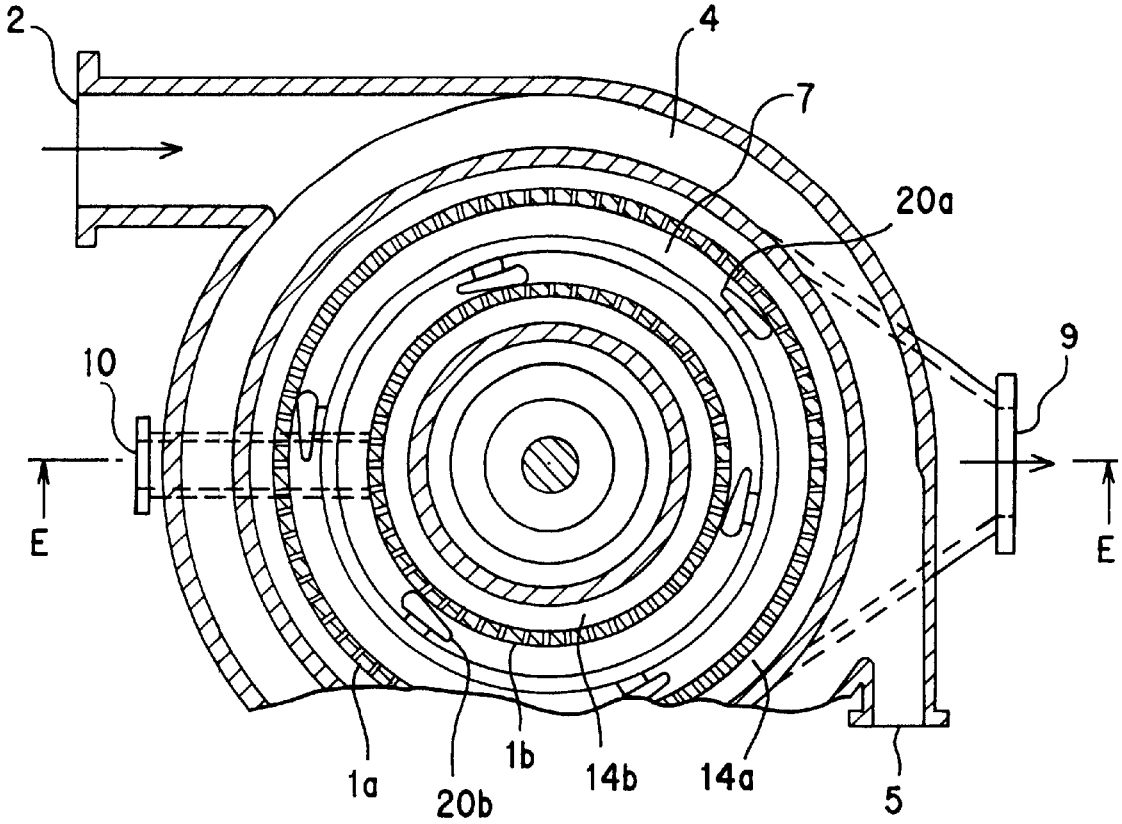
FIG.34 PRIOR ART
FIG. 34 is a sectional view showing another conventional pulp screening device.
Figure 35:
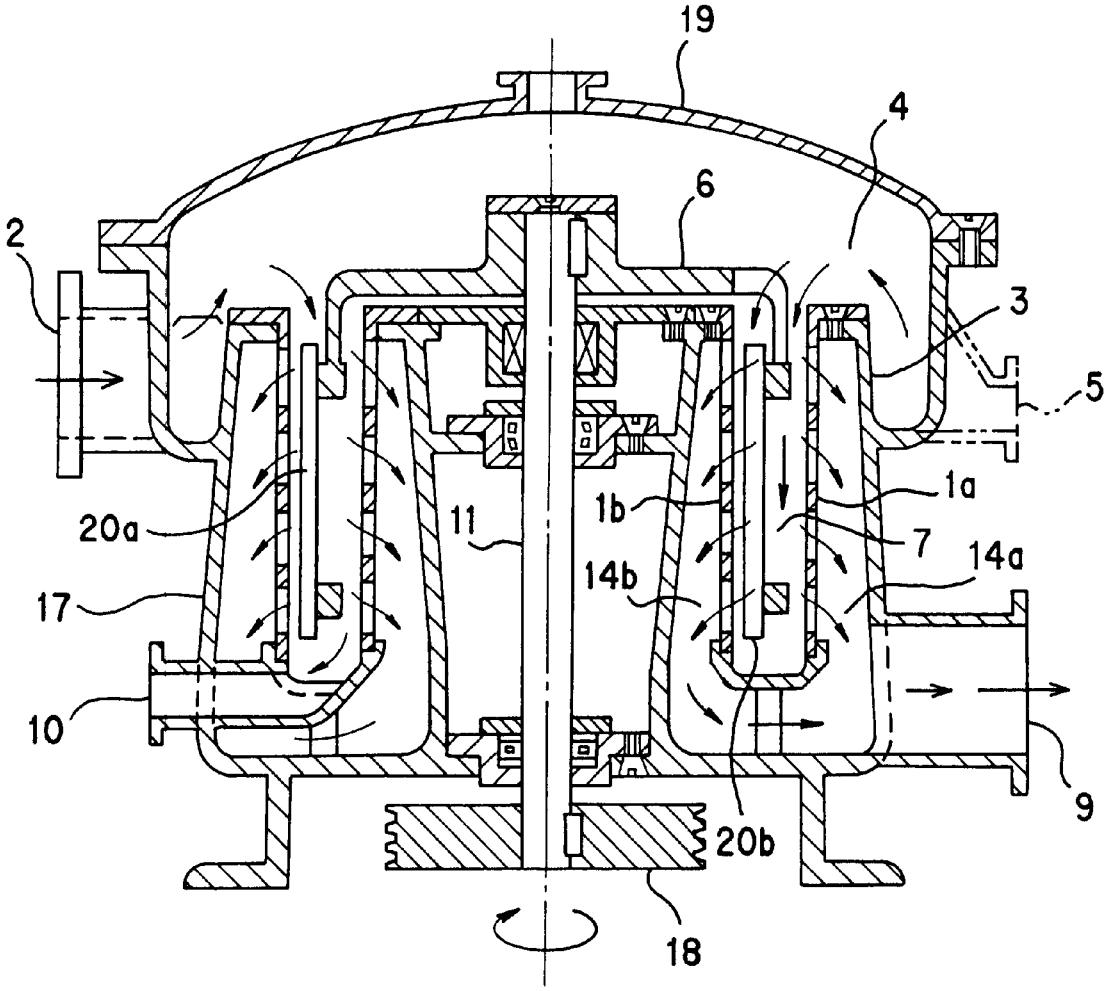
FIG.35 PRIOR ART
FIG. 35 is a sectional view taken substantially along line E—E in FIG. 34.

Note that for the revolution speed of the pulp within the agitation chamber 7, there is a difference in speed between the surface of the outer screen cylinder 1*a* and the surface of the inner screen cylinder 1*b*, because of the difference in diameter therebetween. However, in the pulp screening device of the first embodiment, the spacing between the screen cylinders 1*a* and 1*b* is approximately the same as the thickness of a single common vane 12, and is narrower, compared with the conventional pulp screening device provided with two screen cylinders (see FIGS. 34 and 35). Therefore, the speed difference of the pulp between the inner and outer screen cylinders 1*a* and 1*b* is smaller compared with conventional pulp screening device, and the pressure difference developed by centrifugal force is also smaller compared with conventional pulp screening device.

On the other hand, on the rear portion side of the common vane 12 (behind the edge 203), the pulp is inhibited from flowing into the screen cylinder 1*a* or 1*b* through the space between the surface of the screen cylinder 1*a* or 1*b* and the edge 203. In addition, the spacing between the surface of the screen cylinder 1*a* or 1*b* and the rear curved face 204 widens gradually. Therefore, as illustrated in FIG. 5B, the internal pressure within the agitation chamber 7 results in a great negative pressure, which causes the pulp suspension to flow backward from the exit chambers 14*a*, 14*b* into the agitation chamber 7. With the back flow of the pulp suspension, the lumps of pulp, etc., caught in the holes 100 of the screen cylinders 1*a*, 1*b*, are removed and the pulp density within the agitation chamber 7 is diluted.

The pulp suspension, passed through the outer screen cylinder 1*a* via the agitation chamber 7, and sorted in the outer exit chamber 14*a*, is discharged from the outer discharge tube 16. Also, the pulp suspension, passed through the inner screen cylinder 1*b* via the agitation chamber 7, and sorted in the inner exit chamber 14*b*, is discharged from the exit 9 through the inner discharge tube 15. When this occurs, a static pressure component in the flow from the inner exit chamber 14*b* is increased and a static pressure component in the flow from the outer exit chamber 14*a* is conversely decreased, because the dimension of the cross section of the exit of the inner discharge tube 15 is set equal to or greater than the dimension of the cross section of the outer discharge tube 16 at a point where the outer discharge tube 16 joins the inner discharge tube 15.

From the foregoing description, the pulp screening device of the first embodiment has the following advantages:

First, in the pulp screening device, a single common vane 12 is shared with the inner and outer screen cylinders 1*a*, 1*b* so that the distance between the screen cylinders can be reduced. Therefore, the speed difference of the pulp between the inner and outer screen cylinders 1*a*, 1*b* caused by the difference in diameter therebetween, and the pressure difference caused by centrifugal force, become smaller compared with conventional pulp screening device. As a result, the holes in the inner screen cylinder 1*b* are less likely to be clogged and a reduction in the quantity of pulp to be passed is prevented.

Also, the common vane 12 is provided with the deflection wall 202. Because of this, the agitation chamber 7 is practically partitioned into a plurality of parts by the radial flow of the pulp near the deflection walls 202. This causes the revolution speed of the pulp to rise and the internal pressure within the agitation chamber 7 to rise. Therefore, the separation and agitation of the foreign objects and lumps of pulp at the chamfered portions of the holes 100 in the screen cylinders 1*a* and 1*b* are accelerated, and clogging of the holes 100 is prevented and the quantity of pulp to be passed is increased.

In addition, the radial flow of the pulp near the deflection wall 202 inhibits the pulp from flowing through between the surface of the screen cylinder 1*a* or 1*b* and the edge 203. The formation of the rear curved face 204 behind the edge 203 causes the internal pressure within the agitation chamber 7 to be negative on the rear portion side of the common vane 12. Therefore, the pulp suspension flows backward from the exit chambers 14*a* and 14*b* into the agitation chamber 7. As a result, lumps of pulp, etc., caught in the holes 100 of the screen cylinders 1*a*, 1*b*, are removed, and the pulp density within the agitation chamber 7 is diluted and repassage of high-density pulp not passed through the screen cylinders 1*a*, 1*b* becomes easy.

That is, the pulp screening device of the first embodiment is capable of effectively utilizing both the operating surfaces of the common vane 12 and the surfaces of the inner and outer screen cylinders 1*a*, 1*b* and therefore has the advantage that a large quantity of pulp can be screened and processed with low power at a relatively slow revolution speed, while preventing clogging of the holes in the screen cylinders 1*a*, 1*b*.

Besides, the dimension of the cross section of the exit of the inner discharge tube 15 is set equal to or greater than the dimension of the cross section of the outer discharge tube 16 at a point where the outer discharge tube 16 joins the inner discharge tube 15. Because of this, a static pressure component in the flow from the inner exit chamber 14*b* is increased, whereas a static pressure component in the flow from the outer exit chamber 14*a* is conversely reduced. Therefore, the flow of the pulp from the inner exit chamber 14*b*, which is less liable to flow compared with the outer exit chamber 14*a*, becomes satisfactory. Because of this, there is also an advantage that the quantity of pulp to be passed can be increased.

Furthermore, in the conventional pulp screening device, the tip end portion of the vane is round and the spacing between the tip end portion and the screen cylinder is gradually reduced, and consequently, foreign objects are liable to be caught in the reduced spacing and are difficult to remove. However, in the pulp screening device of the first embodiment, the deflection wall 202 is formed in the common vane 12, whereby there is also an advantage that foreign objects are not caught in the space between the common vane 12 and the screen cylinder 1*a* or 1*b*, as is done in conventional pulp screening device by wedge effect.

Figure 6:
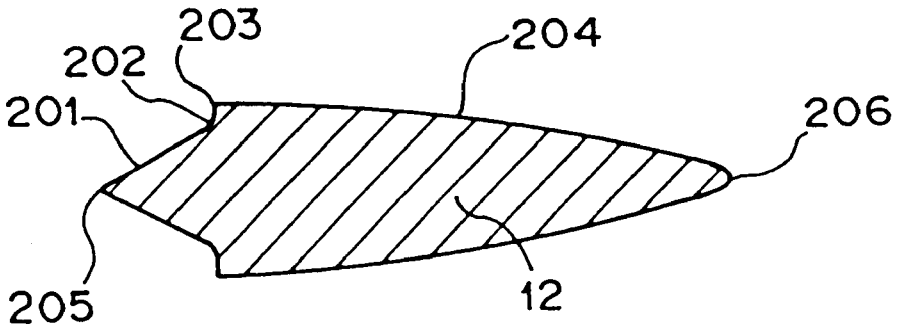
FIG. 6 is a sectional view showing a first variation of the vane of the pulp screening device of the first embodiment of the present invention.
Figure 7:
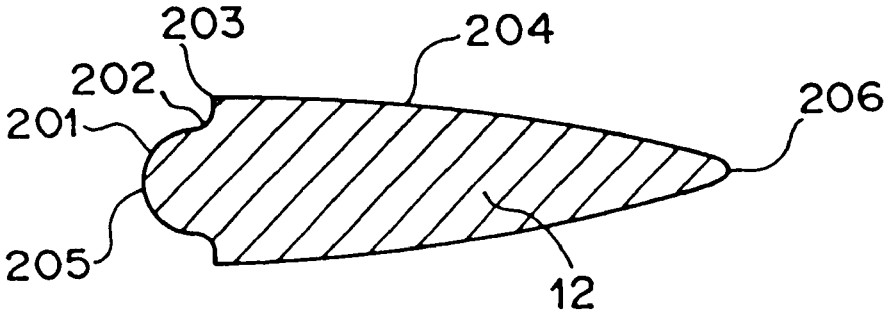
FIG. 7 is a sectional view showing a second variation of the vane of the pulp screening device of the first embodiment of the present invention.
Figure 8:
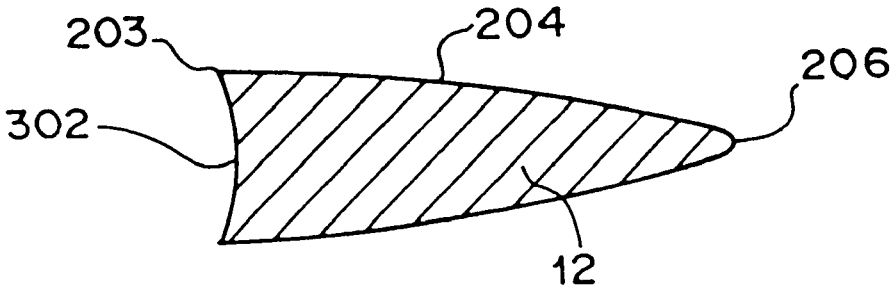
FIG. 8 is a sectional view showing a third variation of the vane of the pulp screening device of the first embodiment of the present invention.

Note that the common vane 12 in the pulp screening device of the first embodiment is not limited to that shown in FIG. 4, The radial thickness, circumferential width, axial length, number of axial divisions, axial inclination, configuration of the front wall, deflection wall, and rear curved face, etc., can be varied according to pulp type, pulp density, screen cylinder hole dimensions, rotor speed, etc. For example, the configuration of the common vane 12 will be satisfied if it has at least a deflection wall and a rear curved face extending from the edge of the deflection wall to the rear end of the vane. Therefore, a front wall 201 may be formed into a flat shape such as that shown in FIG. 6. Also, as illustrated in FIG. 7, the front wall 201 may be formed into a semicircular shape with a tip end 205 as a vertex, Furthermore, as illustrated in FIG. 8, the front wall can be omitted and the vane can be formed with both a concave (or flat) deflection wall 302 and a pair of rear curved faces 204 extending from an edge 203 to a rear end 206.

Figure 9:
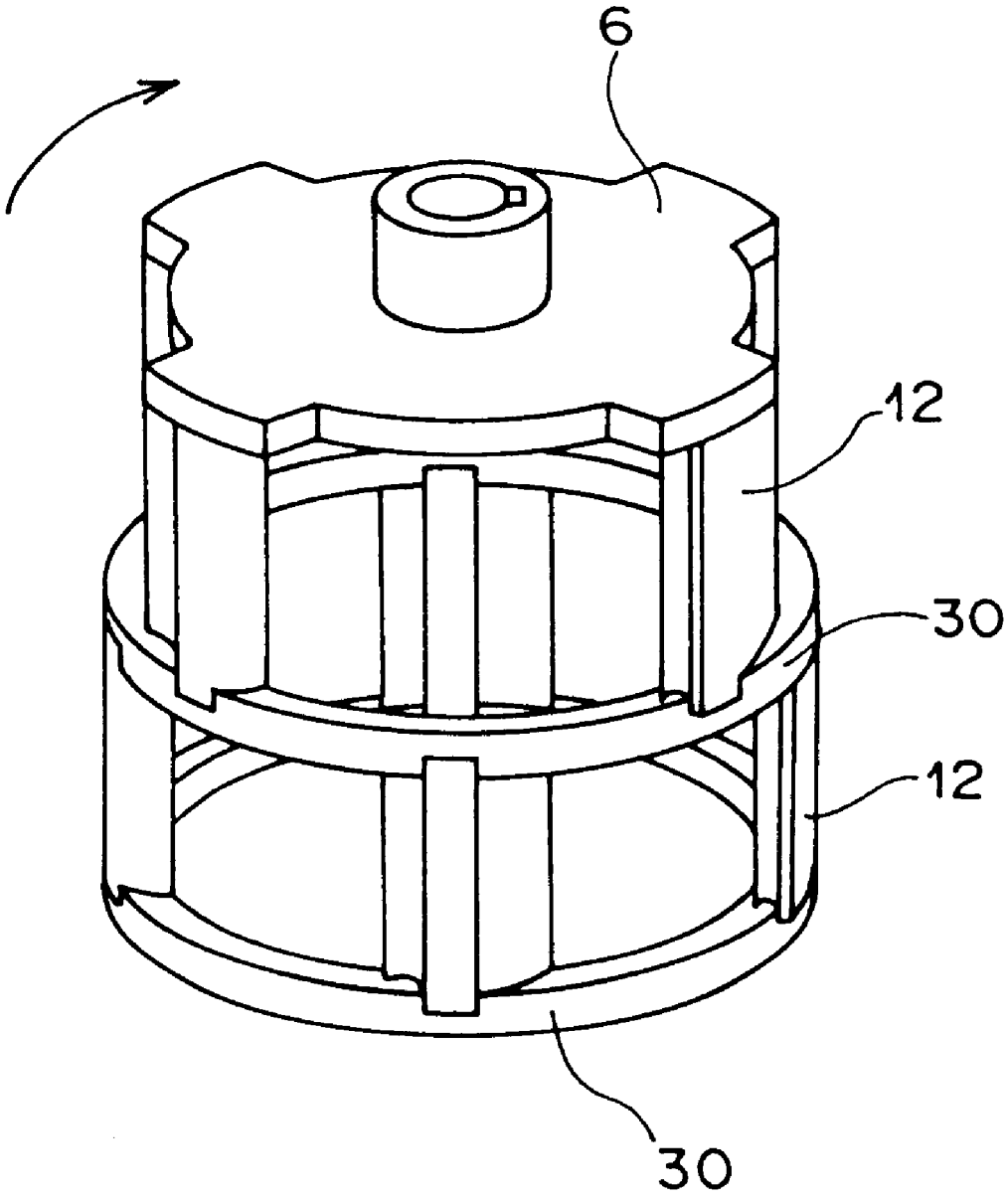
FIG. 9 is a perspective view showing a variation of the rotor of the pulp screening device of the first embodiment of the present invention.

Similarly, the configuration of the rotor 6 is not limited to the one shown in FIG. 3. For instance, as illustrated in FIG. 9, the rotor may be axially divided into two and the upper common vanes and the lower common vanes may be connected by two connection rings 30, and the upper and lower common vanes may be disposed so that they are shifted in phase. According to the construction illustrated in FIG. 9, as with the first embodiment, the agitation chamber 7 can be practically partitioned into a plurality of parts in the circumferential direction by the common vanes 12, and the mechanical strength of the common vanes 12 is enhanced, whereby deformation of the common vanes 12 by centrifugal force can be prevented.

Figure 10:
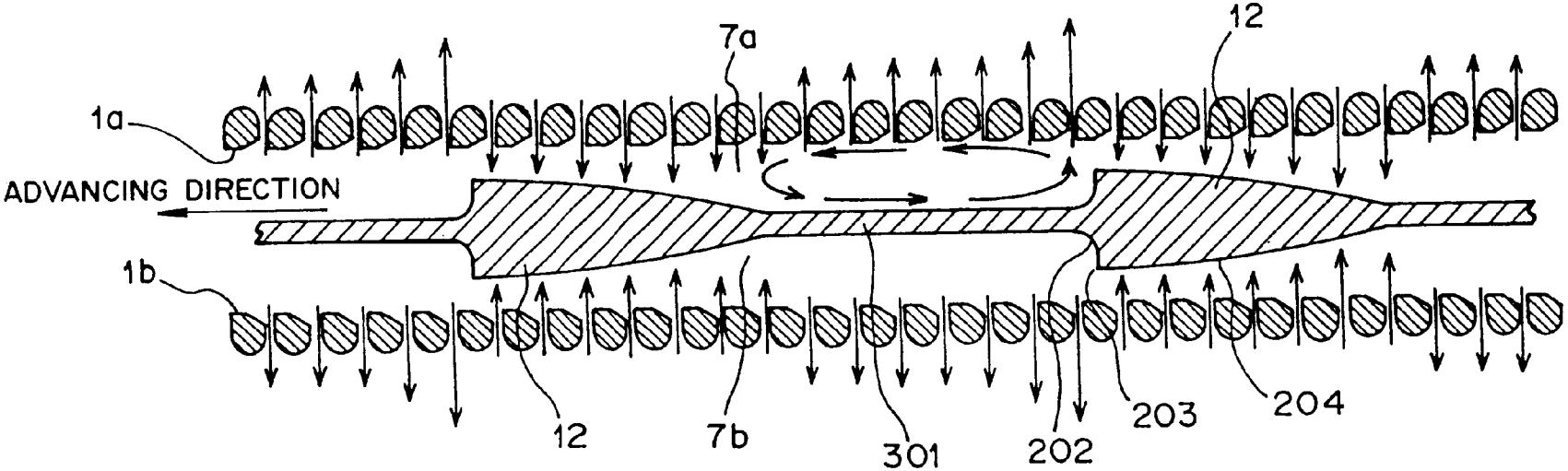
FIG. 10 is a sectional view showing a fourth variation of the vane of the pulp screening device of the first embodiment of the present invention, the positional relationship between the inner and outer screen cylinders and the vane being shown.
Figure 11:
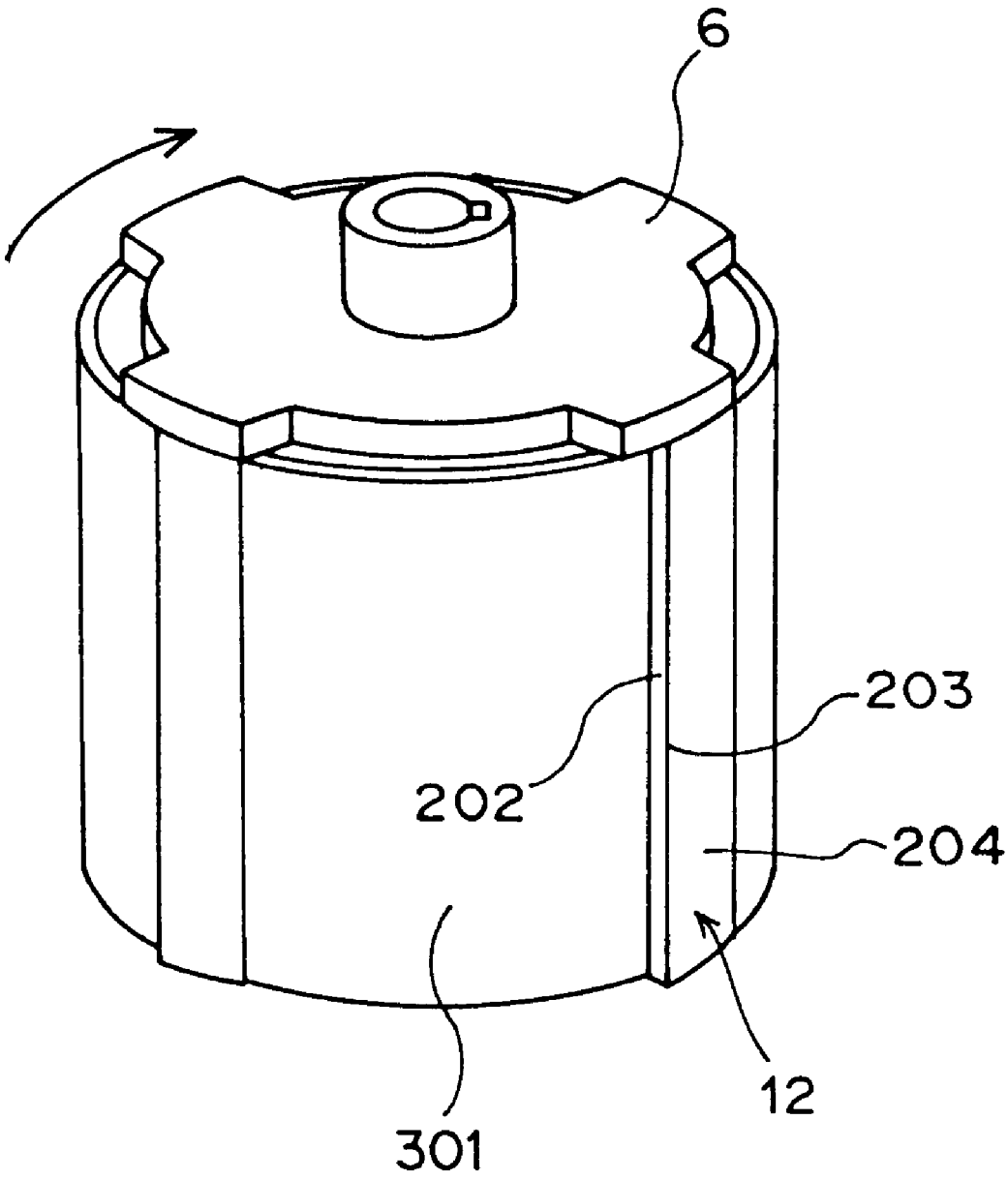
FIG. 11 is a perspective view showing the construction of a rotor that corresponds to the configuration of the common vane shown in FIG. 10.

Moreover, as illustrated in FIGS. 10 and 11, the common vanes 12 may be interconnected by partition walls 301 and the agitation chamber 7 may be separated into an inner agitation chamber 7*a* and an outer agitation chamber 7*b*. If constructed in this manner, the radial flow of the pulp within the agitation chamber 7 (from the inner screen cylinder toward the outer screen cylinder), which results form centrifugal force, can be blocked by the partition walls 301. Therefore, it becomes possible to further increase the quantity of pulp to be passed through the inner screen cylinder 1*a*.

Figure 28:
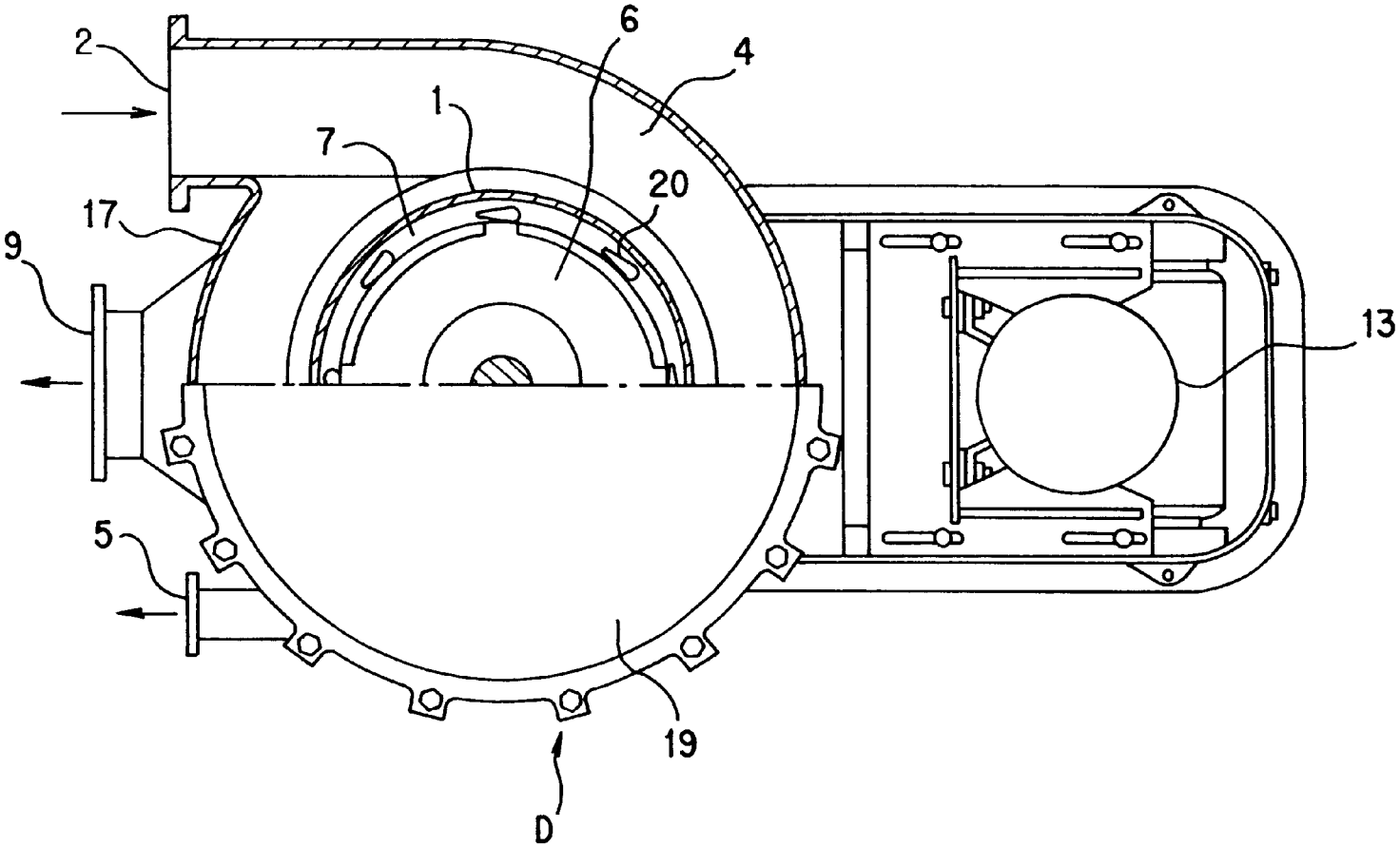
FIG.28 PRIOR ART
FIG. 28 is a part-sectional plan view showing a conventional pulp screening device.
Figure 29:
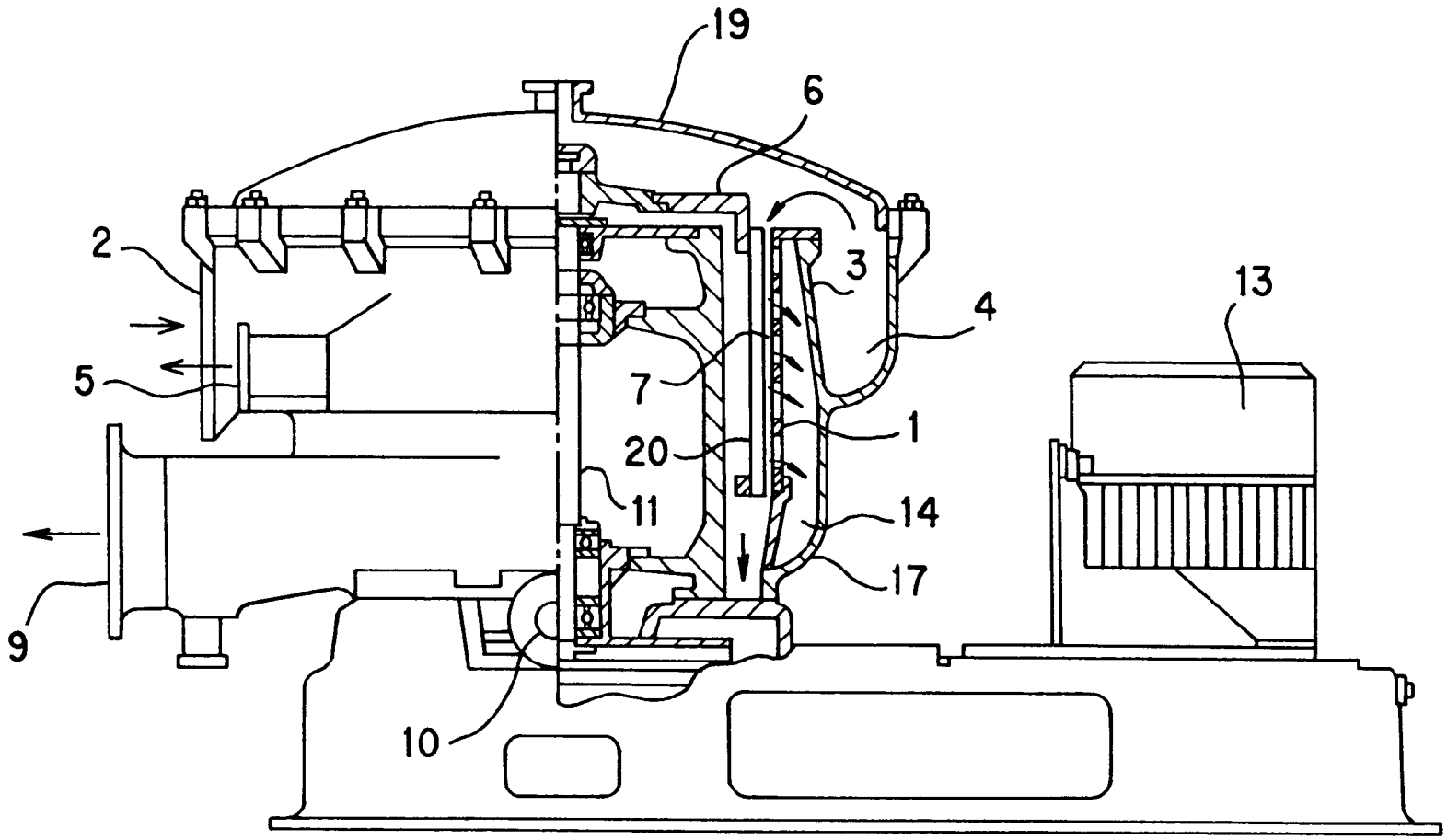
FIG.29 PRIOR ART
FIG. 29 is a part-sectional side view taken in the direction of arrow D of FIG. 28.
Figures 30A, 30B:
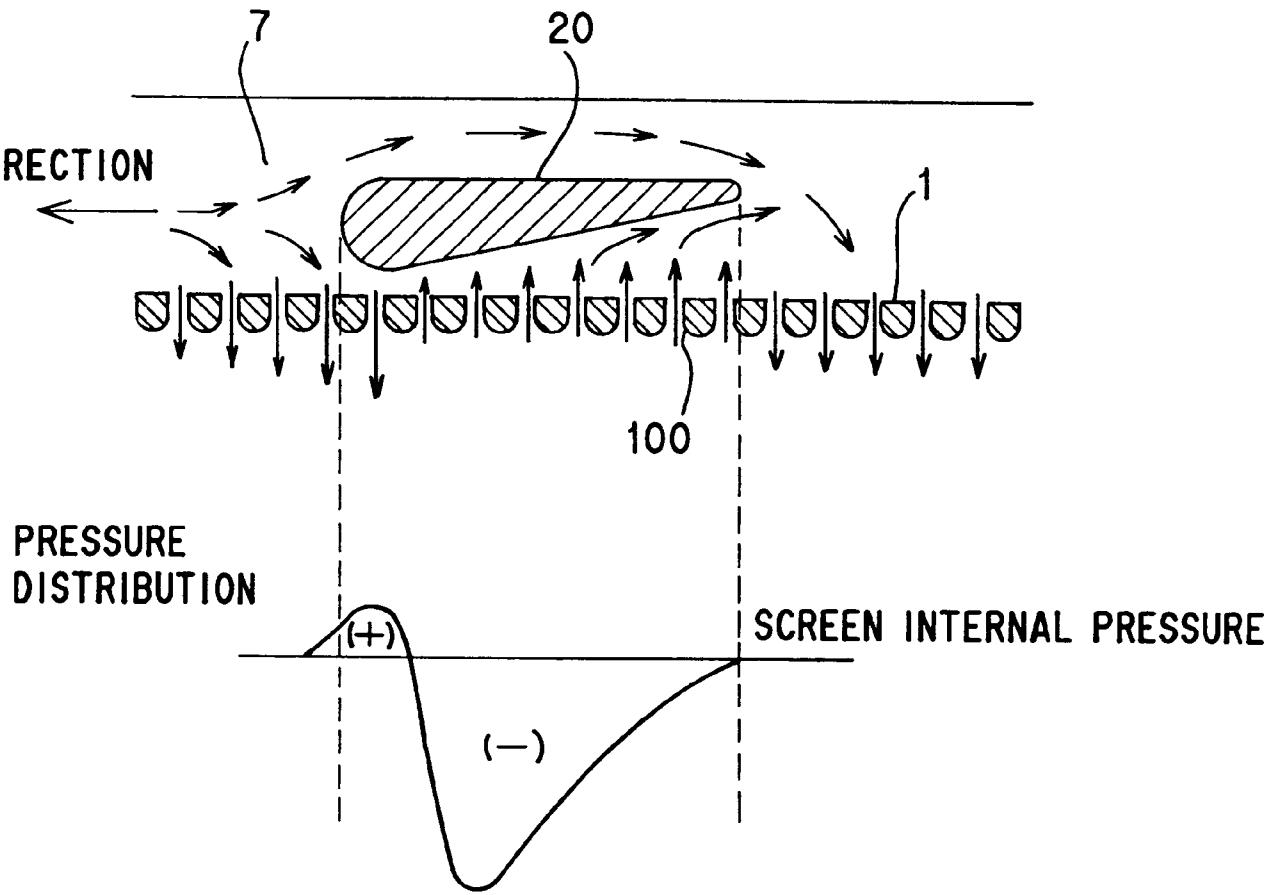
FIG.30A PRIOR ART
FIG.30B PRIOR ART
FIG. 30A is a diagram for explaining the operational effect of the conventional pulp screening device, the positional relationship between the screen cylinder and the vane being shown.
FIG. 30B is a diagram showing a pressure distribution that acts on the screen cylinder in the positional relationship shown in FIG. 30A.

Furthermore, the configuration of the common vane 12 in the pulp screening device of the present invention is not limited to devices provided with two screen cylinders, as in the first embodiment. For instance, it is also applicable to devices having a single screen cylinder outside or inside an agitation chamber, as illustrated in FIG. 28. In this case, the vane will be satisfied if only the portion of the vane opposite to the screen cylinder has at least a deflection wall and a rear curved face extending from the edge of the deflection wall to the rear end of the vane. Even in this case, clogging of holes in the screen cylinder can be reduced, compared with the conventional device having a single screen cylinder outside or inside an agitation chamber (see FIG. 28), and there is an advantage that it becomes possible to screen and process a large amount of pulp.

Figure 12:
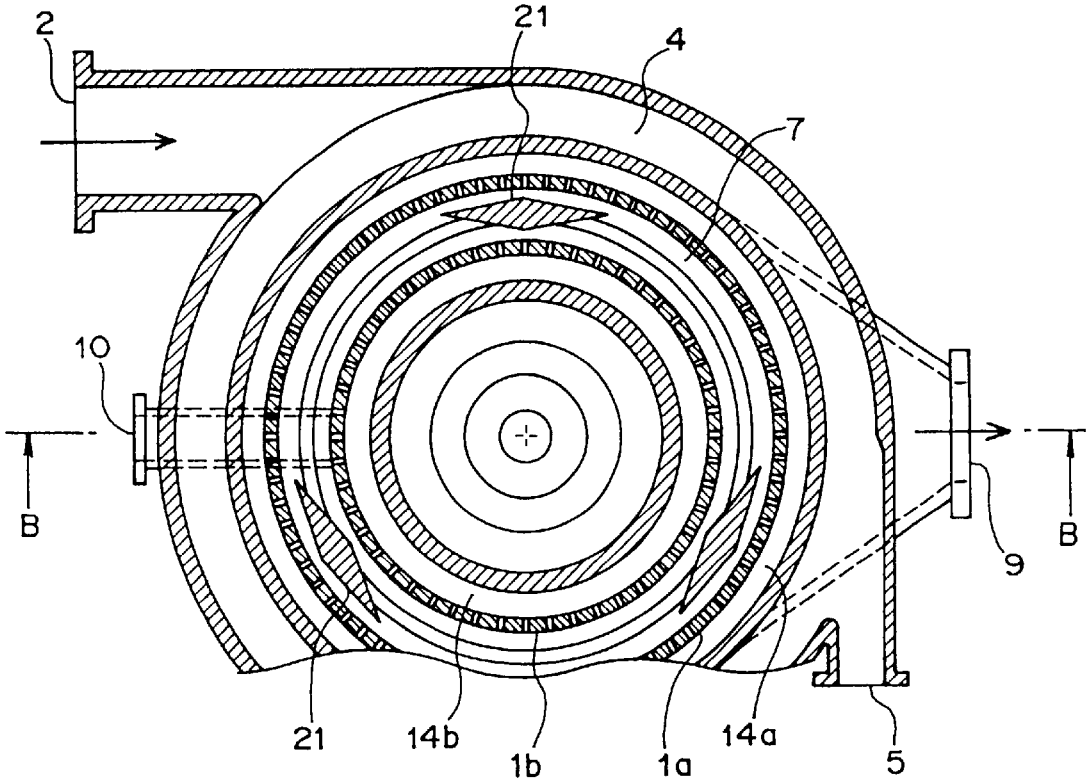
FIG. 12 is a sectional plan view showing a pulp screening device constructed according to a second embodiment of the present invention.
Figure 13:
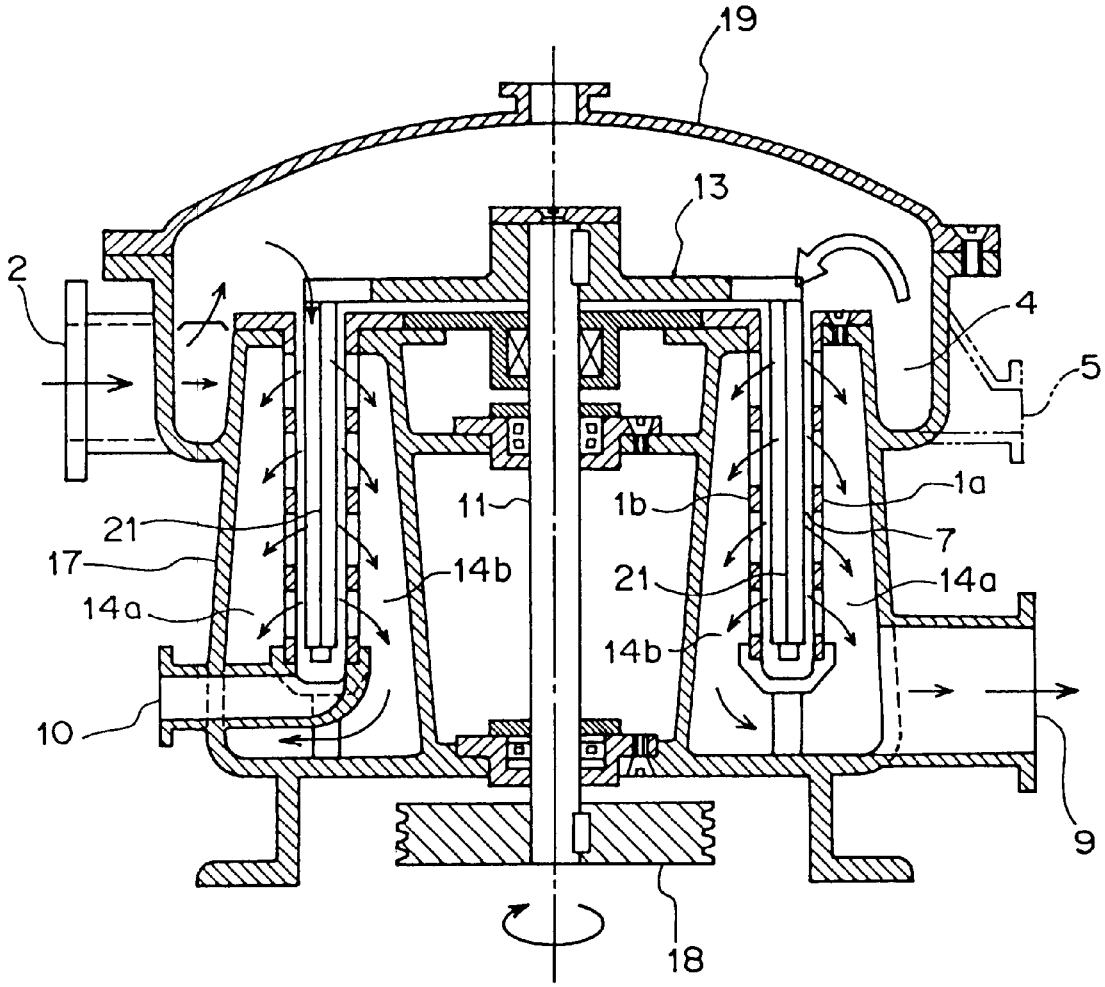
FIG. 13 is a sectional view taken substantially taken along line B—B in FIG. 12.
Figure 14:
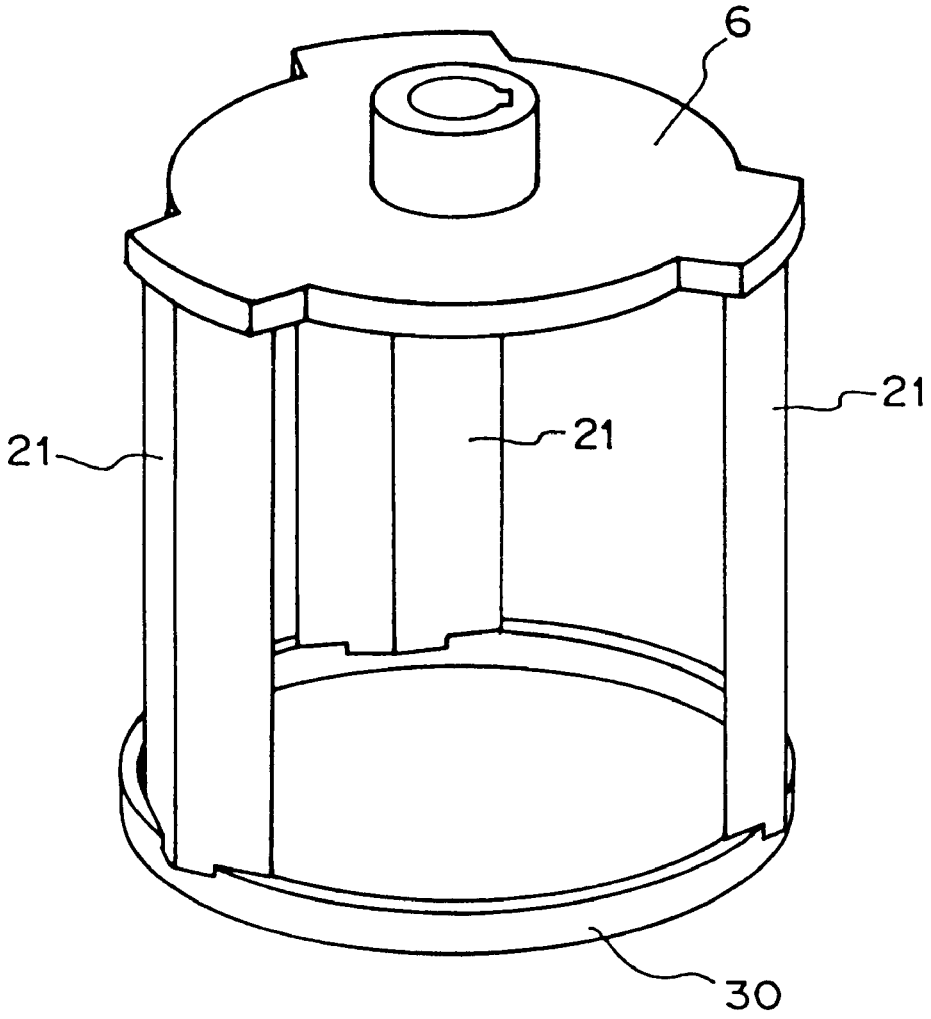
FIG. 14 is a perspective view showing the construction of the rotor of the pulp screening device of the second embodiment of the present invention.
Figure 15:
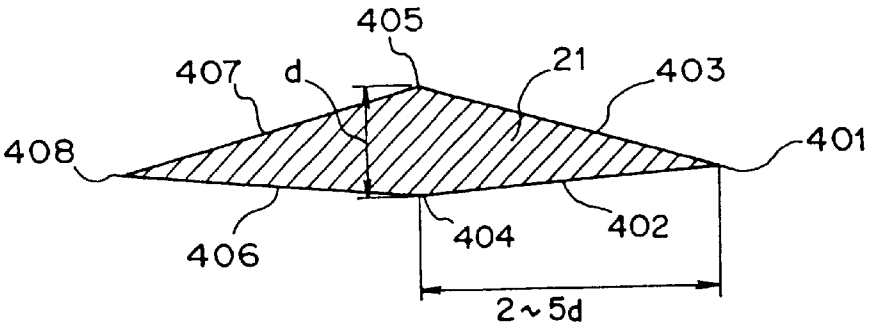
FIG. 15 is a sectional view showing the configuration of the vane of the pulp screening device of the second embodiment of the present invention.

Now, a pulp screening device according to a second embodiment of the present invention will be described with reference to FIGS. 12 to 17. FIG. 12 shows a sectional view of the construction of the pulp screening device of the second embodiment. FIG. 13 shows a sectional view taken along line B—B in FIG. 12. FIG. 14 shows a perspective view of the construction of the rotor of the pulp screening device of the second embodiment. FIG. 15 shows a sectional view of the configuration of the vane of the pulp screening device of the second embodiment. FIG. 16 is used for explaining the operational effect of the pulp screening device of the second embodiment. FIG. 17 is used to explain the operational effect of the configuration of the vane of the pulp screening device of the second embodiment. Note that the same reference numerals will be applied to the same parts as the aforementioned conventional pulp screening device or the pulp screening device of the first embodiment.

The pulp screening device of the second embodiment, as with the first embodiment, has two screen cylinders 1*a*, 1*b* differing in diameter, as illustrated in FIGS. 12 and 13. An agitation chamber 7 is formed between the screen cylinders 1*a* and 1*b*. An outer exit chamber 14*a* is formed outside the outer screen cylinder 1*a*, and an inner exit chamber 14*b* is formed inside the inner screen cylinder 1*b*. The outer exit chamber 14*a* is in fluid communication with the inner exit chamber 14*b* through the bottom portion.

A pulp suspension, flowing in a tangential direction through the entrance 2 of a cylindrical container 17, circulates through an annular flow passage 4. When the pulp suspension is circulating through the flow passage 4, heavy foreign objects such as sand, etc., are discharged outside the device from a trap 5, and the remaining pulp flows from the flow passage 4 into the aforementioned agitation chamber 7.

The screen cylinders 1*a*, 1*b* forming the agitation chamber 7 are provided in the peripheries thereof with a large number of slits of width 0.15 to 0.5 mm or holes of diameter 0.2 to 4.8 mm. Because of this, when the pulp is flowing downward along the agitation chamber 7, the pulp passes through the inner and outer screen cylinders 1*a*, 1*b* and are filtered and sorted in the exit chambers 14*a*, 14*b* and are discharged from an exit 9. On the other hand, the foreign objects of sizes that cannot pass through the screen cylinders 1*a*, 1*b*, as they are, flow downward along the agitation chamber 7 and are discharged from a reject exit 10.

A cylindrical rotor 6 is hung from the upper portion of a main shaft 11 and disposed within the agitation chamber 7. The rotor 6 has a plurality of vanes 21 (hereinafter referred to as distribution vanes, because the primary object of the vanes in the second embodiment is to properly distribute pulp to the inner and outer screen cylinders) at its peripheral surface, as illustrated in FIG. 14. The distribution vanes 21 are interconnected at their lower ends by a connecting ring and are disposed at equal spaces in the circumferential direction of the rotor 6. As illustrated in FIGS. 12 and 13, each distribution vane 21 is located within the agitation chamber 7, holding a predetermined space (preferably 2 to 6 mm) from the inner peripheral surface of the outer screen cylinder 1*a* and the predetermined space from the outer peripheral surface of the inner screen cylinder 1*b*. With this arrangement, the agitation chamber 7 is practically partitioned into a plurality of parts in the circumferential direction by the distribution vanes 21.

The distribution vane 21 in the pulp screening device of the second embodiment is in the shape of a wedge and made up of four flat faces, namely an inner distribution wall 402, an outer distribution wall 403, an inner suction wall 406, and an outer suction wall 407, as illustrated in FIG. 15. An acute-angle front edge 401 is formed at a point where the inner distribution wall 402 and the outer distribution wall 403 join each other. Similarly, an acute-angle rear edge 408 is formed at a point where the inner suction wall 406 and the outer suction wall 407 join each other. An obtuse-angle inner edge 404 is formed at a point where the inner distribution wall 402 and the inner suction wall 406 join each other. Likewise, an obtuse-angle outer edge 405 is formed at a point where the outer distribution wall 403 and the outer suction wall 407 join each other. When a distance from the inner edge 404 to the outer edge 405 (i.e., the thickness of the distribution vane 21) is taken to be "d," a distance from the front edge 401 to a line joining both the inner edge 404 and the outer edge 405 (i.e., the height of the wedge with the distribution vane thickness as its base and the front edge 401 as its vertex) is set to 2 to 5d.

Figure 16A:
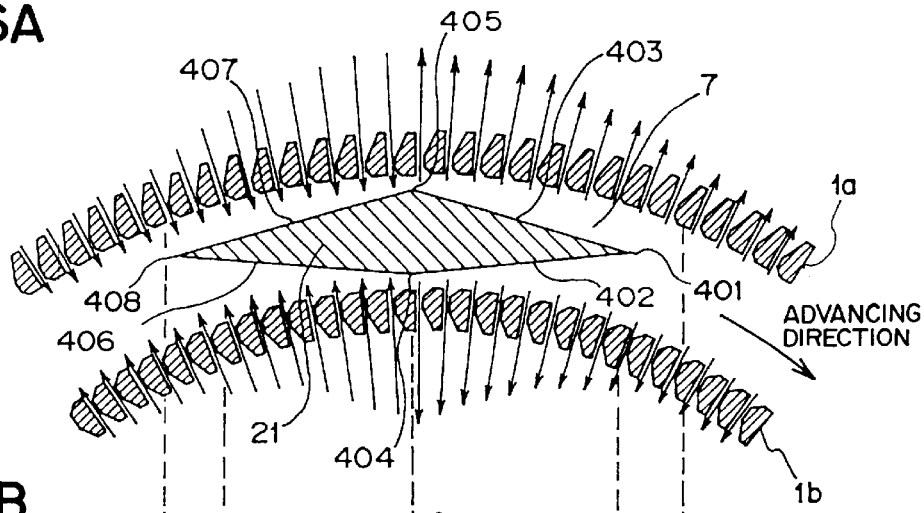
FIG. 16A is a diagram for explaining the operational effect of the pulp screening device of the second embodiment of the present invention, the positional relationship between the inner and outer screen cylinders and the vane being shown.
Figure 17:
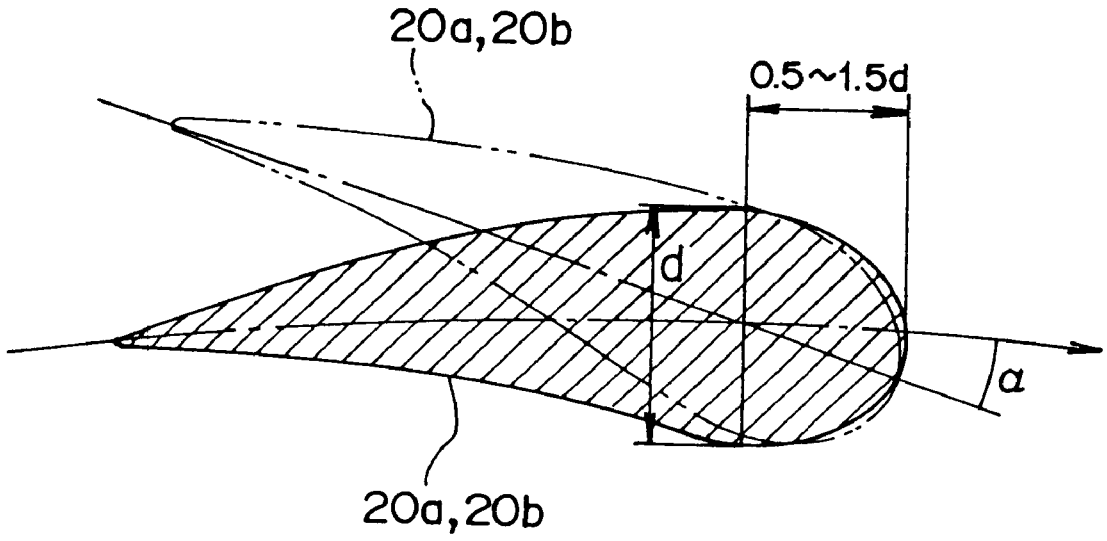
FIG. 17 is a diagram for explaining the operational effect of the pulp screening device of the second embodiment of the present invention, the configuration of a conventional vane which becomes an object of comparison having been shown.

As illustrated in FIG. 12 or FIG. 16A, the distribution vane 21 within the agitation chamber 7 is disposed so that the spacing between the inner edge 404 and the inner screen cylinder 1*b*, and the spacing between the outer edge 405 and the outer screen cylinder 1*a*, become narrowest. In the pulp screening device of the second embodiment, the spacing between the inner edge 404 and the inner screen cylinder 1*b*, and the spacing between the outer edge 405 and the outer screen cylinder 1*a*, are each set to the aforementioned predetermined space (preferably 2 to 6 mm). In addition, the position of the front edge 401 is set so that it is at the center of the agitation chamber 7 or at a position slightly offset from the center toward the outer screen cylinder 1*a*.

Now, a description will be given of the operation of the pulp screening device of the second embodiment constructed as described above.

The pulp suspension, fed from an upstream pump (not shown), first flows in a tangential direction through the entrance 2 of the container 17 and circulates through the flow passage 4. When the pulp suspension is circulating the flow passage 4, the heavy foreign objects in the pulp suspension, such as sand, etc., are discharged outside the device from a trap 5, and the remaining pulp flows into the agitation chamber 7, formed between the screen cylinders 1*a*, 1*b* inside the inner casing 3.

If the distribution vane 21 revolves within and along the annular agitation chamber 7, as shown in FIG. 16A, the pulp within the agitation chamber 7 flows in the direction opposite to the direction of revolution of the distribution vane 21. The revolution flow of the pulp is distributed at the front edge 401 of the distribution vane 21 into a radially inner flow and a radially outer flow. The inwardly distributed pulp flows along the inner distribution wall 402 of the distribution vane 21 and is supplied to the inner screen cylinder 1*b*, while the outwardly distributed pulp flows along the outer distribution wall 403 and is supplied to the outer screen cylinder 1*a*.

The pulp being revolved tends to flow to the side of the outer screen cylinder 1*a* by a difference in pressure, developed by the centrifugal force exerted on the pulp suspension. However, in the pulp screening device of the second embodiment, it becomes possible to equally supply the pulp to the inner and outer screen cylinders 1*b*, 1*a* in accordance with a dimensional ratio of the holes 100 in the inner screen cylinder 1*b* and the holes 100 in the outer screen cylinder 1*a* by adjusting the position of the front edge 401, because, as described above, the revolution flow of the pulp can be distributed at the front edge 401 into radially inner and outer flows.

The reason the position of the front edge 401 can be adjusted in this manner is that the distribution vane 21 is formed into the shape of a wedge having an acute-angle front edge. Assume that in the conventional pulp screening device (see FIG. 34), the maximum thickness of the vane 20*a* or 20*b* is "d", as illustrated in FIG. 17. In the conventional pulp screening device, the distance from the maximum thickness portion to the front end of the vane 20*a* or 20*b* is about 0.5 to 1.5 d, and the vane front end portion is circular in shape and the radius of curvature is about 0.5 d (see FIG. 17). Because of such a vane configuration, the position of the front end (the foremost position with respect to the direction of flow) of the conventional vane 20*a* or 20*b* hardly changes even when the incidence angle a of the vane is adjusted (see the two-dotted line in FIG. 17). This is because the conventional vane 20*a* or 20*b* is provided solely for the purpose of the agitation of pulp within the agitation chamber 7, and the blocking prevention of the screen cylinders 1*a*, 1*b* at the rear portion of the vane by negative pressure, and also because the adjustment of the incidence angle a is made for the purpose of varying the spacing between the rear portion of the vane and the screen cylinder 1*a* or 1*b* in order to adjust the magnitude of the negative pressure.

On the other hand, in the pulp screening device of the second embodiment, the position of the tip end of the distribution vane 21, i.e., the position of the front edge 401 can be adjusted by adjusting the incidence angle a, since the tip end is formed into an acute-angle wedge shape, not a circular shape. Therefore, it becomes possible to equally supply pulp to the inner and outer screen cylinders 1*b*, 1*a* in accordance with a dimensional ratio of the holes 100 in the inner screen cylinder 1*b* and the holes 100 in the outer screen cylinder 1*a*.

Figure 16B:
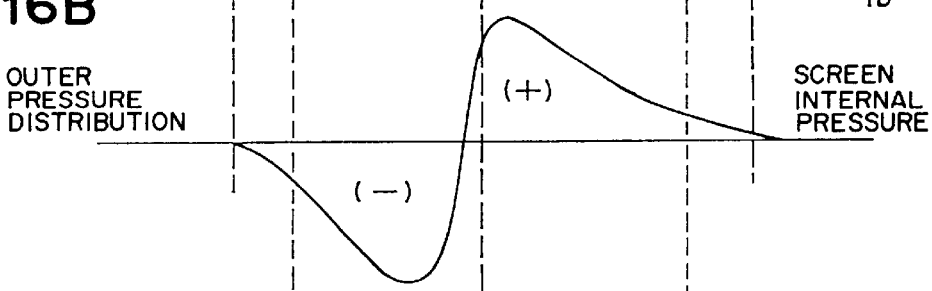
FIG. 16B is a diagram showing a pressure distribution that acts on the outer screen cylinder in the positional relationship shown in FIG. 16A.
Figure 16C:
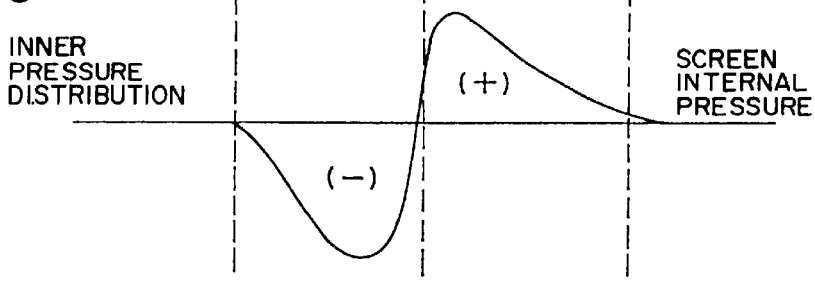
FIG. 16C is a diagram showing a pressure distribution that acts on the inner screen cylinder in the positional relationship shown in FIG. 16A.

The internal pressure within the agitation chamber 7 gradually rises between the front edge 401 and the inner edge 404, when the revolution flow of the pulp passes through the spacing, which is gradually reduced, between the inner distribution wall 402 and the inner screen cylinder 1*a*. Similarly, the internal pressure within the agitation chamber 7 gradually rises between the front edge 401 and the outer edge 405, when the revolution flow of the pulp passes through the spacing, which is gradually reduced, between the outer distribution wall 403 and the outer screen cylinder 1*b*. When this occurs, the revolution flow of the pulp is equally distributed at the front edge 401 to the side of the outer screen cylinder 1*a* and the side of the inner screen cylinder 1*b* in accordance with the aforementioned dimensional ratio of the holes 100. Therefore, the internal pressure within the agitation chamber 7, regardless of a difference in pressure due to centrifugal force, rises approximately the same, between the side of the outer screen cylinder 1*a* and the side of the inner screen cylinder 1*b*, as illustrated in FIGS. 16B and 16C.

On the other hand, on the rear portion side of the distribution vane 21 (behind the inner and outer edges 404, 405), the spacing between the inner suction wall 406 and the inner screen cylinder 1*b*, and the spacing between the outer suction wall 407 and the outer screen cylinder 1*a*, widen gradually from the inner edge 404 and the outer edge 405, respectively. Therefore, as illustrated in FIGS. 16B and 16C, the internal pressure within the agitation chamber 7 results in a great negative pressure, which causes the pulp suspension to flow backward from the exit chambers 14*a*, 14*b* into the agitation chamber 7. With the back flow of the pulp suspension, the lump of pulp, etc., caught in the holes 100 of the screen cylinders 1*a*, 1*b*, are removed and the pulp density within the agitation chamber 7 is diluted.

From the foregoing description, the pulp screening device of the second embodiment has the following advantages:

First, in the pulp screening device, as with the first embodiment, a single distribution vane 21 is shared with the inner and outer screen cylinders 1*a*, 1*b* so that the distance between the screen cylinders can be reduced. Therefore, the speed difference of the pulp between the inner and outer screen cylinders 1*a*, 1*b* caused by the difference in diameter therebetween, and the pressure difference caused by centrifugal force, become smaller compared with conventional pulp screening device. As a result, the holes in the inner screen cylinder 1*b* become less liable to be clogged and a reduction in the quantity of pulp to be passed is prevented.

Also, the revolution flow of the pulp can be distributed into a radially inner flow and a radially outer flow by the front edge 401 of the distribution vane 21. Therefore, the pulp can be supplied equally to the outer screen cylinder 1*a* and the inner screen cylinder 1*b* independently of centrifugal force action. As a result, when the quantity of pulp to be passed is excessively reduced, clogging due to a back flow at the inner screen cylinder 1*b* is prevented. Also, when the quantity of pulp to be passed is increased, clogging due to an increase in passage resistance at the outer screen cylinder 1*a* is prevented. That is, the load required for processing the pulp can be balanced between the inner screen cylinder 1*b* and the outer screen cylinder 1*a*, and consequently, a flow-rate range for the pulp is not limited as is done in conventional pulp screening device.

In addition, the agitation chamber 7 is practically partitioned into a plurality of parts by a plurality of distribution vanes 21, so the revolution speed of the pulp becomes approximately the same as the revolution speed of the distribution vane 21. Because of this, agitation of the pulp within the agitation chamber 7 is accelerated, and there is no possibility that a good quality of pulp will flow downward without being processed and will be discharged from the reject exit 10, and consequently, the screening efficiency rises. In addition, a rise in the revolution speed of the pulp accelerates the separation and agitation of the foreign objects and lumps of pulp at the chamfered portions of the holes 100 in the screen cylinders 1*a* and 1*b*. As a result, clogging of the holes 100 is prevented and the quantity of pulp to be passed is increased.

Besides, the spacing between the inner suction wall 406 and the inner screen cylinder 1*b*, and the spacing between the outer suction wall 407 and the outer screen cylinder 1*a*, widen gradually from the inner edge 404 and the outer edge 405, respectively. Therefore, the pressure within the agitation chamber 7 becomes negative on the rear portion side of the distribution vane 21, and the pulp suspension flows backward from the exit chambers 14*a*, 14*b* into the agitation chamber 7. As a result, lumps of pulp, etc., caught in the holes 100 of the screen cylinders 1*a*, 1*b*, are removed. Furthermore, the pulp density within the agitation chamber 7 is diluted, and repassage of high-density pulp, which is not passed through the screen cylinders 1*a*, 1*b*, becomes easy.

Thus, the pulp screening device of the second embodiment, as with the first embodiment, is capable of obtaining the advantage that a large quantity of pulp to be passed can be assured with low power, by preventing clogging of the screen cylinders 1*a*, 1*b*.

Furthermore, the pulp screening device of the second embodiment has also the following advantages, because the height of the wedge shape of the distribution vane 21 is set to a range of 2 to 5 times the base of the wedge (i.e., when a distance from the inner edge 404 to the outer edge 405 is taken to be "d," a distance from the front edge 404 to a line joining both the inner edge 404 and the outer edge 405 is set to 2 to 5d).

That is, in the case where the height of the wedge shape of the distribution vane 21 is less than twice the base of the wedge shape, the revolution flow within the agitation chamber 7 changes sharply and results in a radial flow toward the surface of the screen cylinder 1*a* or 1*b*. Therefore, this radial flow can effectively partition the agitation chamber 7, but there is a possibility that foreign objects will pass through slits or holes along with the radial flow and, by this amount, the screening efficiency will be reduced.

On the other hand, if the height of the wedge shape of the distribution vane 21 exceeds five times the base of the wedge shape, the friction resistance of the distribution vane 21 will increase and therefore the operating power per unit processing ability will rise. In addition, a plurality of distribution vanes 21 are disposed, but if the height of the wedge shape becomes higher (i.e., if the vane width becomes wider), adjacent distribution vanes 21 will become too close. As a result, there is also a possibility that proper distribution of the pulp cannot be performed.

Therefore, it is suitable that the height of the wedge shape of the distribution vane 21 be set to a range of two to five times the base of the wedge shape. Since the pulp screening device of the second embodiment is correctly set to the aforementioned range, there is no reduction in the screening efficiency and no rise in the operating power per unit processing ability. Therefore, it becomes possible to prevent clogging of the screen cylinders 1*a*, 1*b* and assure a large quantity of pulp to be passed with low power.

Moreover, for the vane of the conventional pulp screening device, the cross section, taken in the direction perpendicular to the axis, is not a curved surface formed in a fixed curvature and requires straightness in the axial direction. Because of this, there is a problem that the manufacturing cost will be increased. However, the distribution vane 21 in the pulp screening device of the second embodiment is formed with four flat faces, an inner distribution wall 402, an outer distribution wall 403, an inner suction wall 406, and an outer suction wall 407. Therefore, there is also an advantage that machining is easy and manufacturing costs can be reduced.

Note that the distribution vane 21 in the pulp screening device of the second embodiment is not limited to the configuration shown in FIG. 15. The radial depth, circumferential width, axial length, axial inclination, number of vanes, configuration of the inner distribution wall, outer distribution wall, inner suction wall, and outer suction wall, etc., can be varied according to pulp type, pulp density, screen cylinder hole dimensions, rotor speed, etc., without departing from the scope of the invention hereinafter claimed.

That is, the configuration of the distribution vane 21 will be satisfied, if it is formed from at least four wall faces, an inner distribution wall, an outer distribution wall, an inner suction wall, and an outer suction wall and is in the form of an acute-angle wedge in the tip end direction, and if, when it is assumed that a distance from the inner edge to the outer edge is "d," a distance from the front edge to a line joining both the inner edge and the outer edge is set to 2 to 5d.

Figure 18:
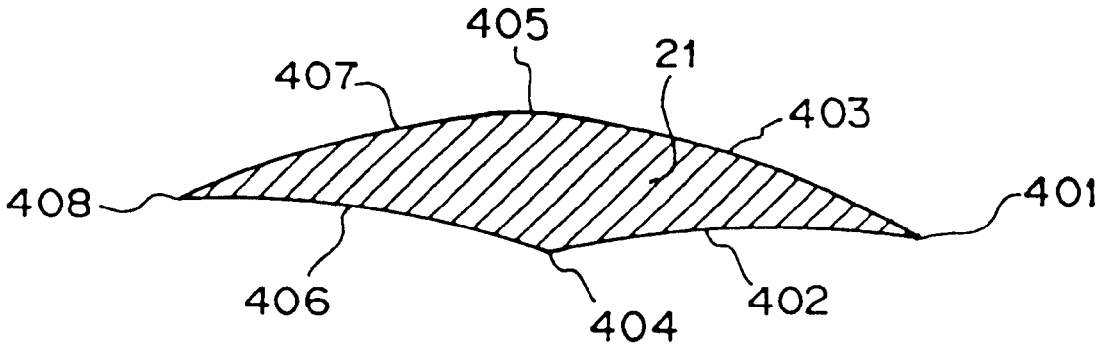
FIG. 18 is a sectional view showing a first variation of the vane of the pulp screening device of the second embodiment of the present invention.
Figure 19:
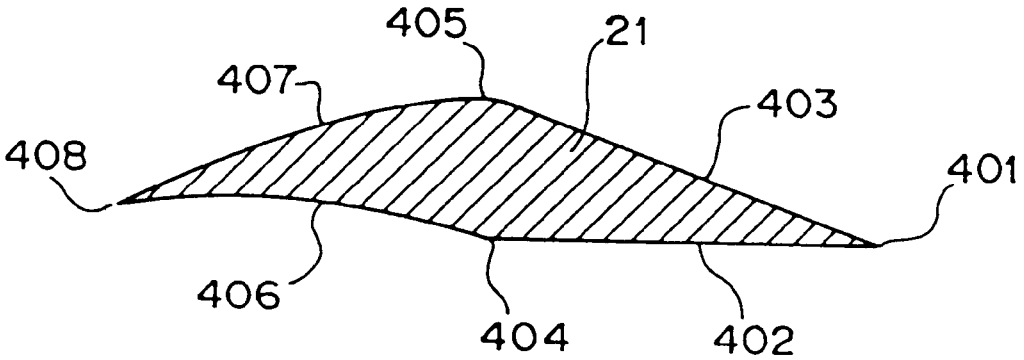
FIG. 19 is a sectional view showing a second variation of the vane of the pulp screening device of the second embodiment of the present invention.
Figure 20:
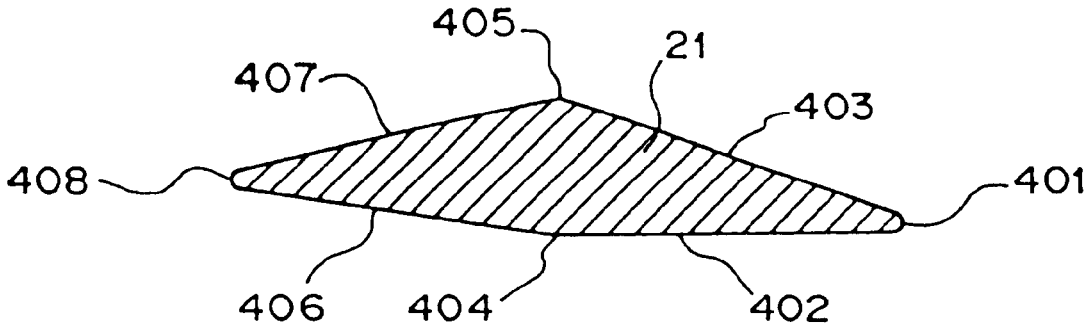
FIG. 20 is a sectional view showing a third variation of the vane of the pulp screening device of the second embodiment of the present invention.
Figure 21:
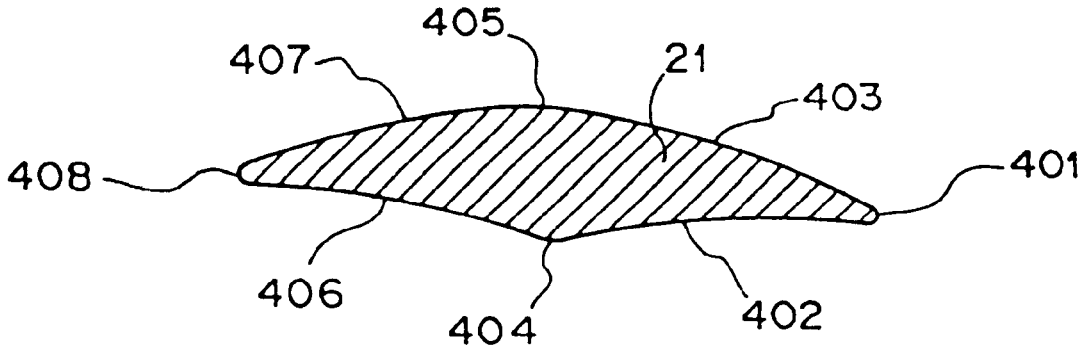
FIG. 21 is a sectional view showing a fourth variation of the vane of the pulp screening device of the second embodiment of the present invention.
Figure 22:
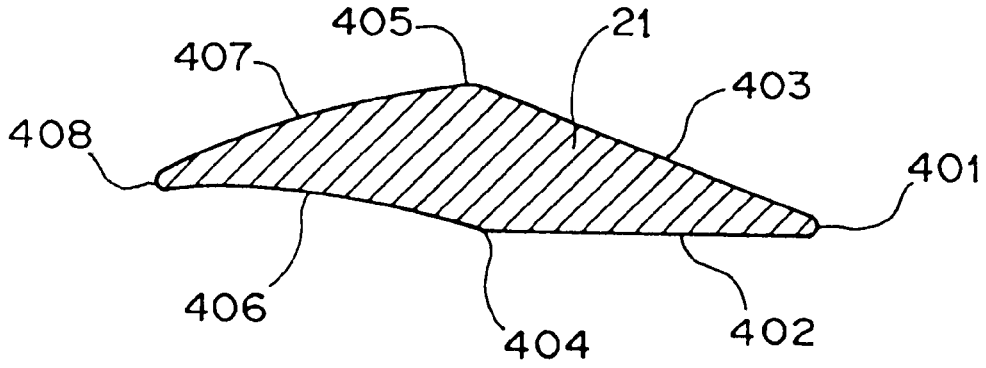
FIG. 22 is a sectional view showing a fifth variation of the vane of the pulp screening device of the second embodiment of the present invention.

Therefore, for example, as illustrated in FIG. 18, an outer distribution wall 403 and an outer suction wall 407 may be formed into convex faces, and an inner distribution wall 402 and an inner suction wall 406 may be formed into concave faces. In addition, as illustrated in FIG. 19, an inner distribution wall 402 and an outer distribution wall 403 may be formed into flat faces, and an outer distribution wall 407 and an inner suction wall 406 may be formed into convex and concave faces, respectively. Furthermore, as illustrated in FIGS. 20 to 22, the front and rear edges 401, 408 in the distribution vanes 21 of FIGS. 15, 18, and 19 may be rounded.

Note that it is possible to make the thickness d of the distribution vane 21 constant, since the spacing between the inner screen cylinder 1*b* and the outer screen cylinder 1*a* can be made constant within the operational range of the device independently of cylinder diameter. In the case where a small-diameter screen cylinder with a large curvature is employed, however, there are cases where the height of the wedge shape of the distribution vane 21 is limited to less than 5 d (i.e., less than five times vane thickness).

Figure 23:
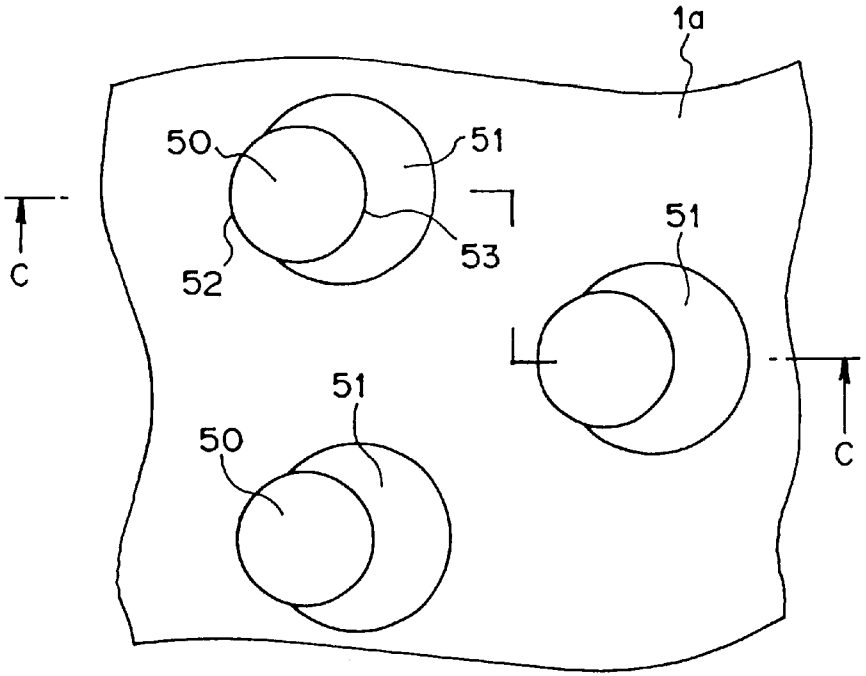
FIG. 23 is a plan view showing the construction of the screen cylinder of a pulp screening device constructed according to a third embodiment of the present invention.
Figure 24:
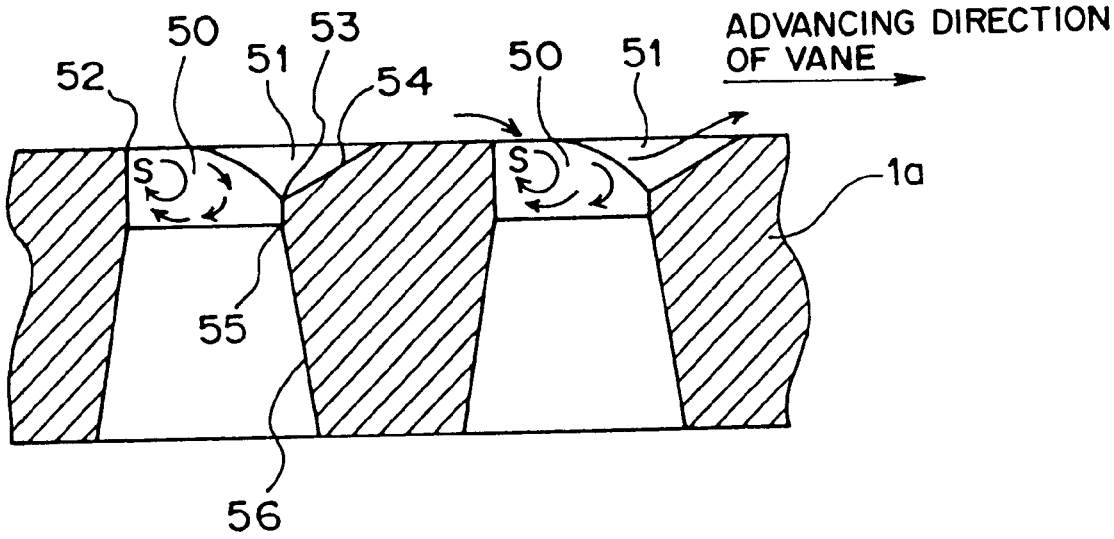
FIG. 24 is a sectional view taken substantially taken along line C—C in FIG. 23.

Next, a pulp screening device according to a third embodiment of the present invention will be described with reference to FIGS. 23 and 24. FIG. 23 shows a plan view of the construction of the screen cylinder of the third embodiment. FIG. 24 shows a sectional view taken along line C—C in FIG. 23. Note that the same reference numerals will be applied to the same parts as the aforementioned embodiments.

While the first and second embodiments are characterized in vane construction, the pulp screening device of the third embodiment is characterized only in screen cylinder construction, particularly hole configuration, and the remaining construction is the same as the conventional pulp screening device (refer to FIGS. 28 and 29, or FIGS. 34 and 35). In the third embodiment, therefore, only the screen cylinder construction will preponderantly be described, and a description of the remaining construction is omitted. Note that in the third embodiment, a description will be made in the case where the present invention is applied to the outer screen cylinder 1*a* of a double screen cylinder.

In the pulp screening device of the third embodiment, conical hollows 51 are bored zigzag in the surface of the screen cylinder 1*a*, as illustrated in FIGS. 23 and 24. A hole (round hole) 50 is provided to be offset on the upstream side of revolution flow (i.e., in the direction opposite to the advancing direction of the vane) from the center of the corresponding conical hollow 51. The front edge 52 (positioned on the upstream side of the revolution flow) of the round hole 50 is positioned outside the outer peripheral circle of the conical hollow 51, and the rear edge 53 (positioned on the downstream side of the revolution flow) is positioned inside the outer peripheral circle of the conical hollow 51. With this arrangement, the front edge 52 is formed substantially perpendicular to the surface of the screen cylinder 1*a*, while the rear edge 53 has an obtuse angle and constitutes the inlet of the conical hollow 51 along with the inclined face of the conical hollow 51. The round hole 50 is bored toward an exit chamber 14*a* (see FIG. 13) and forms an axial wall 55, and is joined with an enlarged passage 56 widening toward the exit chamber 14*a*.

Next, a description will be made of the operation of the pulp screening device of the third embodiment constructed as described above.

The front edge 52 of the round hole 50 is formed substantially perpendicular to the surface of the screen cylinder 1*a*. Therefore, when the revolution flow of pulp takes place, a strong, turbulence S develops at the inlet of the round hole 50, and the pulp is satisfactorily agitated. Since the rear edge 53 is formed to have an obtuse angle, a lump of pulp and foreign objects are prevented from being caught in the rear edge 53. Furthermore, the turbulence S is near the front edge 52, so foreign objects are easily removed and clogging of the round hole 50 is prevented. Therefore, there is an advantage that clogging can be prevented even when vanes are revolved at relatively low speeds and that a large quantity of pulp can thus be screened and processed with low power.

In addition, in the pulp screening device of the third embodiment, the center of the round hole 50 is offset from the center of the conical hollow 51 in the direction opposite to the direction of the revolution flow, whereby the front edge 52 for developing the turbulence S is also used as the hole inlet and the dimension of the inclined portion 54 is assured. Therefore, the zigzag pitch can be reduced and there is also an advantage that the number of round holes 50 per unit area can be increased and that the quantity of pulp to be passed is thus increased.

Furthermore, the conical hollow 51 can be formed into the required configuration with a minimum amount of machining (e.g., mechanical machining such as drilling, etc., or electron beam machining such as laser machining, etc.). Therefore, the conical hollow 51 is advantageous in mechanical strength and there is also advantage that a thin flat plate can be employed in the screen cylinder 1*a*.

Figure 25:
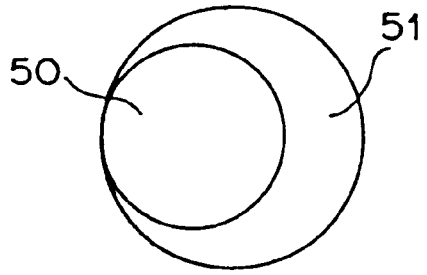
FIG. 25 is a diagram showing a first variation of the positional relationship between the conical hollow and round hole of the pulp screening device constructed of the third embodiment of the present invention.
Figure 26:
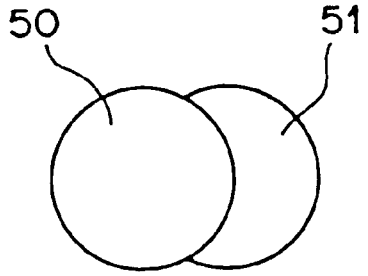
FIG. 26 is a diagram showing a second variation of the positional relationship between the conical hollow and round hole of the pulp screening device of the third embodiment of the present invention.
Figure 27:
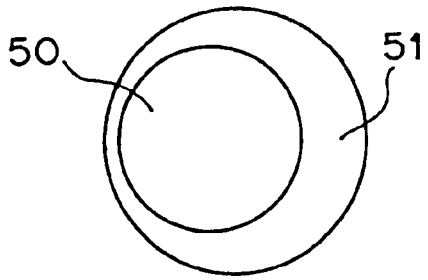
FIG. 27 is a diagram showing a third variation of the positional relationship between the conical hollow and round hole of the pulp screening device of the third embodiment of the present invention.

Note that the construction of the screen cylinder 1*a* of the pulp screening device of the third embodiment is not limited to the one illustrated in FIGS. 23 and 24, but will be satisfied if at least the front edge 52 of the round hole 50 is formed substantially perpendicular to the screen cylinder surface, and if the rear edge 53 has an obtuse angle and constitutes the hole inlet along with the inclined portion 54 of the conical hollow 51. Therefore, as illustrated in FIG. 25, the outer peripheral circle of the conical hollow 51 may coincide with the front edge 52 of the round hole 50. As illustrated in FIG. 26, the diameter of the outer peripheral circle of the conical hollow 51 may coincide with the diameter of the round hole 50, and the rear edge 53 of the round hole 50 may be disposed at the center of the conical hollow 51. Furthermore, as illustrated in FIG. 27, the round hole 50 is disposed within the outer peripheral circle of the conical hollow 51. In this case, however, the front edge 52 of the round hole 50 is formed substantially perpendicular to the screen cylinder surface, and the center position of the round hole 50 is offset on the upstream side of the revolution flow.

Furthermore, the construction of the screen cylinder in the pulp screening device of the present invention is not limited to devices provided with two screen cylinders, as in the third embodiment. For instance, it is also applicable to devices having a single screen cylinder outside or inside an agitation chamber, as illustrated in FIG. 28.

Although the present invention has been described by way of the three embodiments thereof, the invention is not limited to the embodiments. For example, the common vanes in the first embodiment may be combined with the screen cylinders of the third embodiment. The distribution vanes in the second embodiment may be combined with the screen cylinders of the third embodiment. With these combinations, clogging of the screen cylinder is more effectively prevented, and furthermore, it becomes possible to process a great quantity of pulp with low power.

What is claimed is:

1. A pulp screening device, comprising:

an inner screen cylinder;

an outer screen cylinder located outside the inner screen cylinder;

an agitation chamber formed between said inner screen cylinder and said outer screen cylinder, into which a pulp suspension is fed;

an inner exit chamber formed inside said inner screen cylinder into which a pulp suspension screened by said inner screen cylinder is discharged;

an outer exit chamber formed outside said outer screen cylinder into which a pulp suspension screened by said outer screen cylinder is discharged; and one or a plurality of vanes which revolve within said agitation chamber, holding a predetermined small space from each of said inner and outer screen cylinders.

2. The pulp screening device as set forth in claim 1, wherein a revolution-direction front portion of said vane has a wall face extending radially toward the peripheral surfaces of said inner and outer screen cylinders.

3. The pulp screening device as set forth in claim 2, wherein said wall face is formed at a right or acute angle to said direction of revolution.

4. The pulp screening device as set forth in claim 2, wherein the cross section of said vane is formed so that the spacing between said cross section and each of said inner and outer screen cylinders widens gradually from said wall face in said direction of revolution.

5. The pulp screening device as set forth in claim 2, including a pair of wall faces disposed on opposite sides of said vane.

6. The pulp screening device as set forth in claim 1, wherein adjacent vanes of said plurality of vanes are connected by a partition wall.

7. A pulp screening device, comprising:

a pair of inner and outer screen cylinders; and one or a plurality of vanes which revolve within an agitation chamber formed between said inner and outer screen cylinders, holding a predetermined small space from each of said inner and outer screen cylinders;

wherein the cross section of said vane is formed into the shape of a wedge extending at an acute angle from a revolution-direction tip end to both proximity portions closest to said inner and outer screen cylinders.

8. The pulp screening device as set forth in claim 7, wherein a distance from said tip end to said both proximity portions is set to two to five times a distance between said both proximity portions.

9. The pulp screening device as set forth in claim 7, wherein said tip end is disposed at a center between said inner and outer screen cylinders, or at a position offset from said center toward said outer screen cylinder.

10. The pulp screening device as set forth in claim 7, wherein the cross section of said vane is formed so that the spacing between said cross section and each of said inner and outer screen cylinders widens gradually from said both proximity portions in said direction of revolution.

11. A pulp screening device, comprising:

a pair of inner and outer screen cylinders; and one or a plurality of vanes which revolve within an agitation chamber formed between said inner and outer screen cylinders, holding a predetermined small space from each of said inner and outer screen cylinders;

wherein the cross section of an inner discharge tube at a point where said inner discharge tube joins an outer discharge tube is set greater than the cross section of said outer discharge tube, pulp being passed through said inner screen cylinder and flowing in said inner discharge tube and also being passed through said outer screen cylinder and flowing in said outer discharge tube.

12. A pulp screening device, comprising:

a screen cylinder; and one or a plurality of vanes which revolve within an agitation chamber formed outside or inside said screen cylinder, holding a predetermined small space from said screen cylinder;

wherein a revolution-direction front portion of said vane includes a deflection wall for changing the circumferential flow of a pulp suspension in said agitation chamber to a radial flow, and said vane is formed so that a spacing between said vane and said screen cylinder widens gradually from a portion near said screen cylinder of said deflection wall toward a revolution-direction rear end.

13. The pulp screening device as set forth in claim 12, wherein the front surface of said vane includes a pair of deflection walls disposed on opposite sides of said vane.

14. A pulp screening device, comprising:

a screen cylinder having a plurality of filter holes; and one or a plurality of vanes which revolve within an agitation chamber formed outside or inside said screen cylinder, holding a predetermined small space from said screen cylinder;

wherein a plurality of conical hollows are provided in the peripheral surface of said screen cylinder which faces said agitation chamber, said conical hollows comprising respective conical surfaces intersecting with the agitation chamber side edge of said filter hole and the peripheral surface of said screen cylinder at at least one point; and said filter holes are formed to be offset from the center of said conical hollow in the direction opposite to the direction in which said vane revolves.

* * * * *